US010897091B2

(12) United States Patent
Ramirez et al.

(10) Patent No.: US 10,897,091 B2
(45) Date of Patent: Jan. 19, 2021

(54) 3D TRIPOLAR ANTENNA AND METHOD OF MANUFACTURE

(71) Applicants: Ramiro A. Ramirez, Greensboro, NC (US); Marcia Golmohamadi, Colchester, VT (US); Thomas M. Weller, Corvallis, OR (US); Jeffrey Frolik, Essex Junction, VT (US)

(72) Inventors: Ramiro A. Ramirez, Greensboro, NC (US); Marcia Golmohamadi, Colchester, VT (US); Thomas M. Weller, Corvallis, OR (US); Jeffrey Frolik, Essex Junction, VT (US)

(73) Assignees: University of South Florida, Tampa, FL (US); The University of Vermont and State Agricultural College, Burlington, VT (US)

( * ) Notice: Subject to any disclaimer, the term of this patent is extended or adjusted under 35 U.S.C. 154(b) by 44 days.

(21) Appl. No.: 16/247,236

(22) Filed: Jan. 14, 2019

(65) Prior Publication Data

US 2019/0221948 A1 Jul. 18, 2019

Related U.S. Application Data

(60) Provisional application No. 62/616,839, filed on Jan. 12, 2018.

(51) Int. Cl.

| | |
|---|---|
| ***H01Q 21/28*** | (2006.01) |
| ***H01Q 9/04*** | (2006.01) |
| ***H01Q 1/36*** | (2006.01) |
| ***H01Q 21/24*** | (2006.01) |
| ***H01Q 9/30*** | (2006.01) |

(Continued)

(52) U.S. Cl.

CPC ..... *H01Q 21/28* (2013.01); *H01Q 1/36* (2013.01); *H01Q 3/24* (2013.01); *H01Q 3/26* (2013.01); *H01Q 9/0428* (2013.01); *H01Q 9/30* (2013.01); *H01Q 21/24* (2013.01); *H01Q 23/00* (2013.01)

(58) Field of Classification Search

CPC ..... H01Q 21/28; H01Q 9/04; H01Q 9/0428; H01Q 21/24; H01Q 3/24; H01Q 3/26; H01Q 9/30; H01Q 23/00

See application file for complete search history.

(56) References Cited

U.S. PATENT DOCUMENTS 6,091,364 A * 7/2000 Murakami ..... H01Q 1/084 343/700 MS 8,179,325 B2 5/2012 Edwards et al.

(Continued)

OTHER PUBLICATIONS

Frolik, J. et al., On random and Multidimensional Channel Effects in Cluttered Environments, IEEE Antennas and Wireless Propagation Letters, 2017, vol. 16, pp. 1863-1866.

(Continued)

*Primary Examiner* — Hoang V Nguyen

(74) *Attorney, Agent, or Firm* — Molly L. Sauter; Smith & Hopen, P.A.

(57) ABSTRACT

In various embodiments, a three-dimensional (3D) printed tripolar antenna fabricated through additive manufacturing techniques to match the geometries of various commercial wireless node packages is provided. The antenna systems are designed to mitigate harsh channel conditions by implementing polarization diversity between three mutually orthogonal monopoles.

18 Claims, 19 Drawing Sheets

(51) Int. Cl.

| | |
|---|---|
| ***H01Q 3/24*** | (2006.01) |
| ***H01Q 3/26*** | (2006.01) |
| ***H01Q 23/00*** | (2006.01) |

(56) References Cited

U.S. PATENT DOCUMENTS

| | | | | |
|---|---|---|---|---|
| 2008/0087973 | A1* | 4/2008 | Wang | H01Q 15/0086 257/431 |
| 2012/0007791 | A1* | 1/2012 | Grbic | H01Q 1/38 343/895 |
| 2012/0075156 | A1* | 3/2012 | Noguchi | H01Q 3/44 343/837 |

OTHER PUBLICATIONS

Golmohamadi, M. et al., Depolarization in three dimensions: Theoretical formulations and empirical results, 2016 IEEE 17th Annual Wireless and Microwave Technology Conference (WAMICON), 2016, Clearwater, FL, pp. 1-6.

Golmohamadi, M. et al., Characterization of a geometrically constrained tripolar antenna under M2M channel conditions, 2017 11th European Conference on Antennas and Propagation (EUCAP), Mar. 2017, pp. 2998-3002.

Ketterl, Y. et al., A 2.45 GHz phased array antenna unit cell fabricated using 3-D multi-layer direct digital manufacturing, IEEE Transactions on Microwave Theory and Techniques, Dec. 2015, vol. 63, No. 12, pp. 4382-4394.

Mehmood, Y. et al., M2M communications in 5G: State-of-the-art architecture, recent advances, and research challenges, IEEE Communications Magazine, 2017, vol. 55, No. 9, pp. 194-201.

Ramirez, R. A. et al., 3D printed on-package tripolar antennas for mitigating harsh channel conditions, 2017 IEEE Radio and Wireless Symposium (RWS), Jan. 2017, pp. 62-64.

Ramirez, R. A. et al., Additive manufactured tripolar antenna system for link improvement in high multipath environments, 2017 IEEE International Symposium on Antennas and Propagation USNC/URSI National Radio Science Meeting, 2017, pp. 2539-2540.

Vera-Lopez, A. L. et al., Ka-band characterization and RF design of Acrynolitrile Butadiene Styrene (ABS), 2015 IEEE MTT-S International Microwave Symposium, May 2015, pp. 1-4.

* cited by examiner

3D TRIPOLAR ANTENNA AND METHOD OF MANUFACTURE

CROSS-REFERENCE TO RELATED APPLICATIONS

This application claims priority to U.S. Provisional Patent Application No. 62/616,839 filed on Jan. 12, 2018, entitled "3D Tripolar Antenna and Method of Manufacture", which is incorporated by reference herein in its entirety.

GOVERNMENT INTEREST STATEMENT

This invention was made with government support under ECCS 1509762 and ECCS 1508907 awarded by the National Science Foundation. The Government has certain rights in the invention.

BACKGROUND OF THE INVENTION

The Internet of Things (IoT) or Industrial Internet, generally refers to systems of electro-mechanical machines and devices interconnected to one another through embedded wireless sensors and actuators. A network that enables continuous machine-to-machine (M2M) communication is often realized autonomously without the need for any human intervention. The Machine-To-Machine (M2M) communications market is predicted to grow to in value from US $28B to $200B, by 2022, which is why energy-efficient, small size, reliable and low-cost wireless sensor nodes are of great interest for industrial, commercial and aerospace applications. The devices that comprise the M2M networks will in most cases be expected to undergo alterations in physical temperature, pressure, moisture, etc., and will be deployed in electromagnetically harsh surroundings (e.g., non-line-of-sight (NLOS) and with severe multipath), where the environments may potentially weaken and depolarize a transmitted signal across all three spatial dimensions. In such environments, several copies of the transmitted signal will show up at the receiver, such that each copy corresponds to a distinct multipath component with a distinct delay. The amplitude of these summed signals can experience fast variations over time, space, and frequency due to constructive and destructive combining.

To mitigate such fading effects, diversity-combining of independently fading signal paths can be applied which leverages different frequencies and/or antenna elements. For M2M systems that involve multiple devices, coordinating the best frequency to use is not a viable diversity approach, for it is possible that an appropriate frequency for one particular device-to-device link may exhibit deeper fading in another. Employing multiple antennas (i.e., spatial diversity) requires elements to be located sufficiently far from each other to guarantee uncorrelated fading effects. This constraint makes spatial diversity an undesirable approach for applications (e.g., low-cost IoT systems) where the size of the antenna system is a crucial design parameter.

Along with compactness, energy consumption is an important constraint in the design of wireless sensor nodes. As noted, multi-element antenna diversity can improve link reliability thus allowing for the reduction of the transmitted RF power, but at the cost of a bulkier node design. To address this problem, a cooperative spatial diversity technique has been incorporated in sensor nodes to improve link reliability. The approach utilizes several compact transmitter nodes to send a message to a single destination. The trade-off in this approach is added complexity in node computation and network communications. An alternative method described in the art employs frequency diversity to improve link quality, however this method requires two radios separated by 65 cm for each node and therefore is not suitable for compact installations.

Cross-polarized antenna systems, through their perpendicular/orthogonal elements, provide signal paths that are weakly correlated, while keeping antenna elements collocated. Recently, two-dimensional polarization diversity has been exploited in sensor node design. A dual-polarized 2.4 GHz patch antenna has been proposed for integration into a wireless node to mitigate fading body shadowing effect in wearable communication systems. Implementing selection diversity has improved 1% outage probability 9.5 dB.

In the presence of reflectors and retarders, an environment can lead to depolarization in all three spatial dimensions. In recognition of 3D depolarization, there has been some effort towards designing antennas to leverage the extra degree of freedom. For example, the use of collocated antenna elements with three (one loop and two coplanar dipoles) and four elements (one loop and three mutually orthogonal dipoles) has led to channel capacities greater than a single element antenna. Tri-polarized antennas have also been shown to achieve channel capacities comparable to three spatially separated single polarized antennas in a multiple-input, multiple-output (MIMO) system.

Accordingly, what is needed in the art is a tripolar antenna intended for use in communication channels which experience significant multipath and depolarization conditions. Additionally, a method of manufacturing such an antenna is also needed in the art.

SUMMARY OF INVENTION

In various embodiments, the present invention provides a tripolar antenna intended for communication channels that experience significant multipath and depolarization. In one or more embodiments, the antenna system is integrated into the packaging of a sensor node using an additive manufacturing approach that combines fused deposition modeling (FDM) of the plastic case and micro-dispensing of conductive pastes to realize the antenna elements. As such, in the present invention polarization diversity is leveraged as a means to provide a compact and relatively uncomplicated approach for improving communication link quality in M2M systems.

In one embodiment, the present invention provides a 3D tripolar antenna system which includes, a 3D dielectric substrate comprising a substantially flat bottom dielectric substrate and at least three sloped dielectric substrate walls extending from the flat bottom dielectric substrate. The 3D tripolar antenna system further includes three mutually orthogonal $\lambda/4$ monopole antenna, each one of the three mutually orthogonal $\lambda/4$ monopole antenna printed on a different one of the sloped dielectric substrate walls. In a particular embodiment, the sloped dielectric substrate walls are positioned at an angle of 45°, relative to the bottom dielectric substrate.

The 3D tripolar system may further include a microstrip line printed on the substantially flat bottom dielectric substrate and connected to each of the three mutually orthogonal $\lambda/4$ monopole antenna and a switch coupled to the microstrip line, the switch for selecting one of the three mutually orthogonal $\lambda/4$ monopole antenna.

The 3D tripolar system may may further include a radio signal strength indicator (RSSI) coupled to the switch, the RSSI and switch configured to implement polarization diversity between the three mutually orthogonal λ/4 monopole antenna.

In an additional embodiment, a 3D tripolar antenna system is provided which includes, four sloped dielectric substrate walls extending from the flat bottom dielectric substrate and three pairs of mutually orthogonal λ/4 monopole antenna, wherein each first one of a pair of mutually orthogonal λ/4 monopole antenna is printed on a first substrate wall that is opposite to a second substrate wall on which the second one of the pair of mutually orthogonal λ/4 monopole antenna is printed. The system may further include a microstrip line coupled to the pairs of monopole antenna, a switch coupled to the microstrip line and an RSSI coupled to the switch.

An additive manufacturing method for a 3D tripolar antenna system is additionally provided by the present invention. The method includes, forming a 3D dielectric substrate using fused deposition modeling (FDM), wherein the 3D dielectric substrate comprises a substantially flat bottom dielectric substrate and at least three dielectric substrate walls extending from the flat bottom dielectric substrate and forming three mutually orthogonal λ/4 monopole antenna on the 3D dielectric substrate using micro-dispensing of a conductive material, wherein each one of the three mutually orthogonal λ/4 monopole antenna is printed on a different one of the dielectric substrate walls. The method may further include laser-scanning the 3D dielectric substrate to create a topography mesh to guide a micro-dispensing head to conform to a surface of the 3D dielectric substrate while depositing the conductive material to form the three mutually orthogonal λ/4 monopole antenna.

In a particular embodiment, the 3D dielectric substrate is formed of acrylonitrile butadiene styrene (ABS) and the conductive material is a silver paste.

In various embodiments of the present invention, an additive manufactured tripolar antenna system is designed to operate with a commercially available wireless sensor node and is intended to improve, through selection diversity, a Rayleigh channel into a more benign communication link. The proposed tripolar antenna achieves a return loss greater than 17 dB at 2.4 GHz and, when tested in a multipath Rayleigh-like environment, a median channel loss reduction of 4.3 dB using selection diversity of its three mutually orthogonal elements.

Accordingly, the present invention provides an improved tripolar antenna intended for use in communication channels which experience significant multipath and depolarization conditions.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

In various embodiments, the present invention provides tripolar antenna embodiments that are 3-D printed in a single-piece construction and intended for communication channels that experience significant multipath and depolarization. The antenna systems of the present invention are integrated into the packaging of sensor nodes using an additive manufacturing approach that combines fused deposition modeling (FDM) of the plastic case and micro-dispensing of conductive pastes to realize the antenna elements. Both methods combined have been proven to perform efficiently up to mm-wave frequencies.

The performance of these antenna designs using both traditional antenna characterization measures ($S_{11}$, patterns) and through over-the-air (OTA) testing in a harsh communications environment is provided. It is shown that, the proposed tripolar antenna systems achieve a return loss greater than 15 dB at 2.4 GHz and, when tested in a highly variable multipath environment, a 1% channel improvement of up to 14 dB using selection diversity of system's three mutually orthogonal elements. This improvement is shown herein to correspond directly to improved bit error rate (BER) or could also allow nodes to communicate either at lower transmit power (saving energy) or over greater distances.

The multipolar antenna systems presented herein are custom designed to fit and replace covers of two commercial wireless node packages. Packages with different dimensions and geometries were specifically selected to show the versatility of the additive manufacturing technology.

Figure 1A:
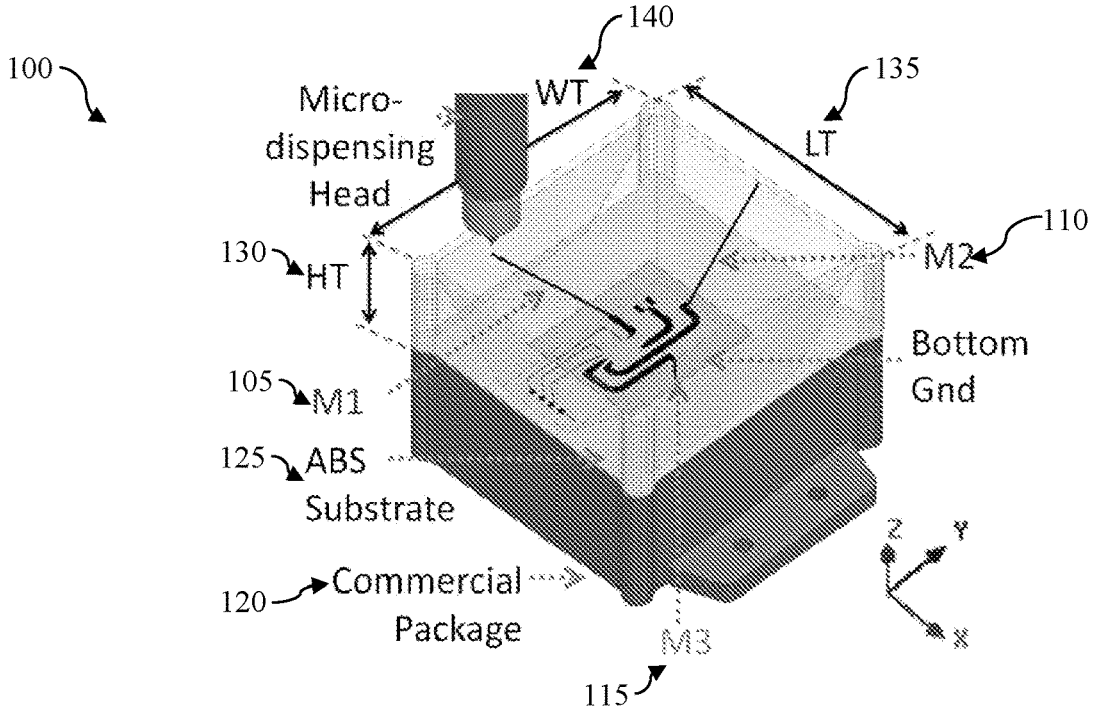
FIG. 1A is an illustration of rectangular antenna design, in accordance with an embodiment of the present invention.
Figure 1B:
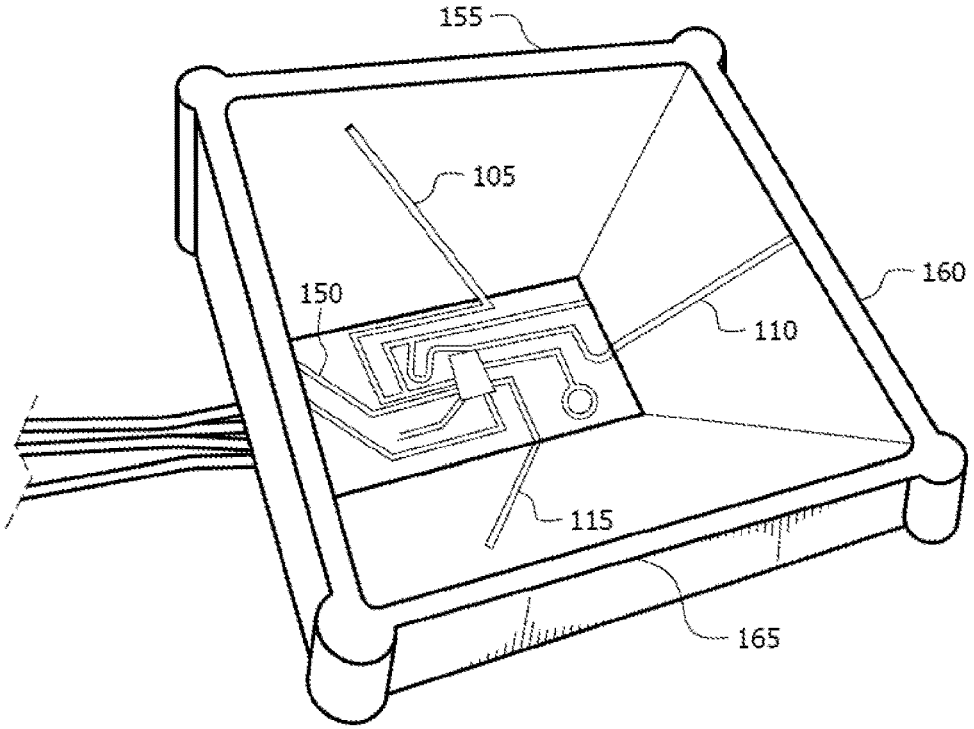
FIG. 1B is a photograph of a fabricated prototype of the rectangular antenna design of FIG. 1A, in accordance with an embodiment of the present invention.

In one embodiment, a proposed rectangular tripolar antenna system 100 in accordance with the present invention is shown in FIG. 1A, which consists of three mutually-orthogonal λ/4 monopoles, M1 105, M2 110 and M3 115, each tuned at 2.4 GHz. The system is custom designed and fabricated to replace the cover of a commercial wireless node package 120. In a particular embodiment, the substrate 125 and conductive elements 105, 110, 115 are fabricated on a single-piece construction of general dimensions HT: 21.01 mm 130, LT: 64.94 mm 135, and WT: 60.11 mm 140. FIG. 1B is a photograph illustrating the dielectric substrate of the presentation formed by additive manufacturing and each of the three mutually orthogonal λ/4 monopoles, M1 105, M2 110 and M3 115 fabricated on different sides of the substrate, utilizing micro-dispensing techniques.

As shown in FIG. 1B, the 3D dielectric substrate 125 of the antenna system 100 includes a substantially flat bottom dielectric substrate 150 and at least three sloped dielectric substrate walls 155, 160, 165 extending from the flat bottom dielectric substrate 150. Additionally, the antenna system includes, three mutually orthogonal λ/4 monopole antenna 105, 110, 115, each one of the three mutually orthogonal λ/4 monopole antenna printed on a different one of the sloped dielectric substrate walls 155, 160, 165.

Figure 2A:
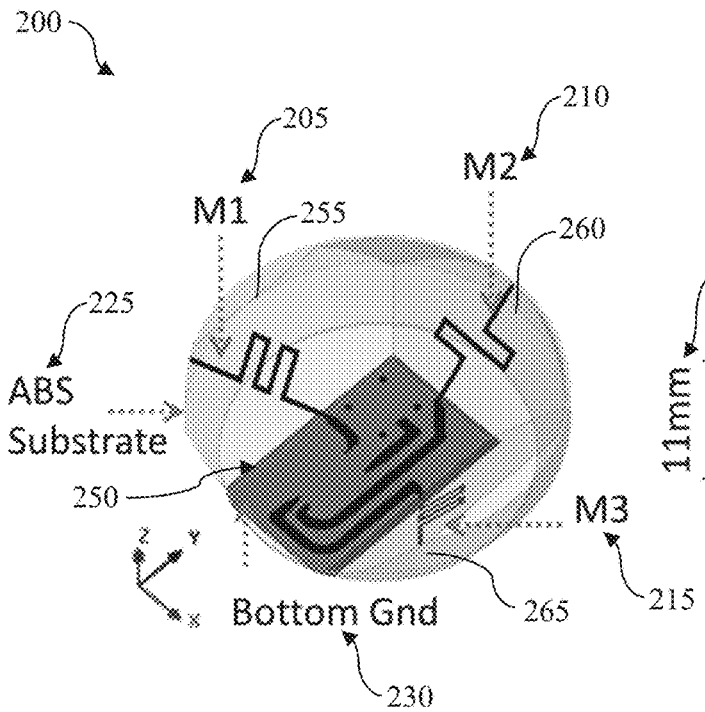
FIG. 2A is top-down illustration of a circular tripolar antenna design, in accordance with an embodiment of the present invention.
Figure 2B:
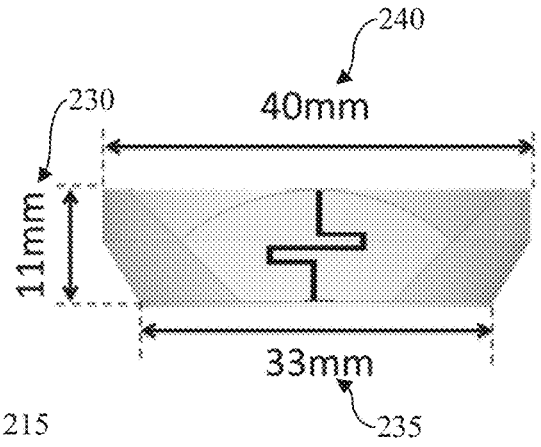
FIG. 2B is a side view illustration of the circular tripolar antenna design of FIG. 2A, in accordance with an embodiment of the present invention.

In another embodiment, FIG. 2 illustrates the dimensions of a 2.4 GHZ circularly-shaped tripolar antenna 200, designed to be placed on top of a cylindrical node. The tripolar circularly-shaped tripolar antenna 200 includes an acrylonitrile butadiene styrene (ABS) substrate 225 and three mutually orthogonal λ/4 monopoles, M1 205, M2 210 and M3 215 fabricated on different sides of the substrate 255, 260, 265 and a bottom ground plane fabricated on a substantially flat bottom dielectric substrate 250. As shown in FIG. 2B, in this particular embodiment, the tripolar antenna 200 has a total height of 11 mm 230, bottom diameter of 33 mm 235 and top diameter of 40 mm 240.

Both antenna designs shown in FIG. 1A and FIG. 2A are based off three mutually orthogonal λ/4 monopoles operating at 2.4 GHz, wherein each radiating element is directly printed over 45° sloped substrate walls, a value that represents the maximum printing angle supported by most additive manufacturing systems, including the one used for this work. The complete process is realized in a single-piece construction, which obviates the need for physical part rotations to achieve orthogonality between the X, Y, and Z antenna elements. Each monopole antenna is fed with a 50Ω microstrip printed over a 500 μm thick flat substrate, the lines are subsequently connected to an externally controlled integrated switching circuit, which is used to switch between the individual polarization states of the antenna system.

Figure 3A:
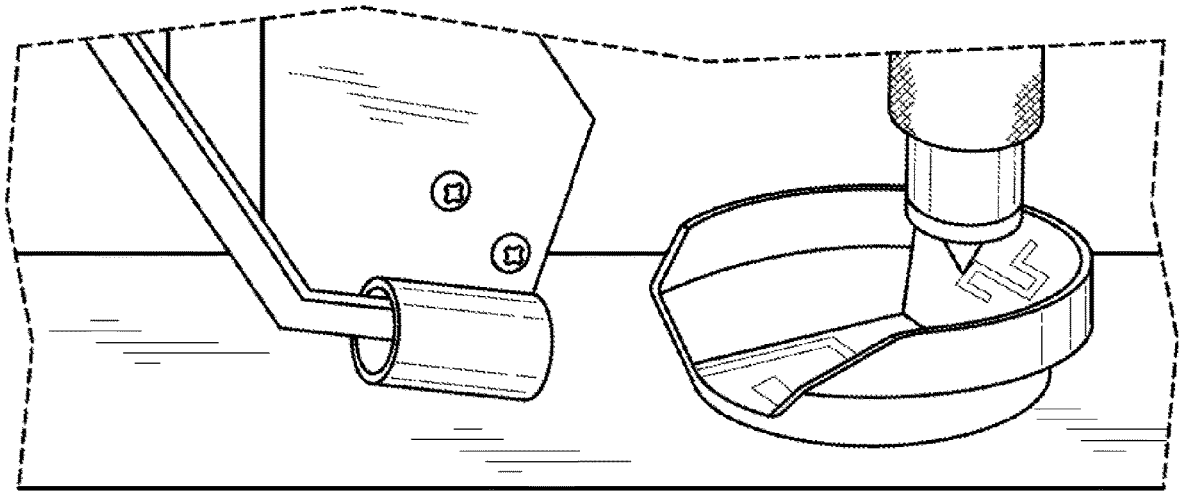
FIG. 3A is a photograph of a micro-dispensing head on a sloped wall, in accordance with an embodiment of the present invention.

The technologies used for the fabrication of the described antenna devices are known as fused deposition modeling (FDM) and micro-dispensing. FDM utilizes acrylonitrile butadiene styrene (ABS) with measured properties at 1 GHz of εr~2.6 and tan δ~0.0058, to create the three-dimensional (3D) dielectric substrate. While forming the 3D dielectric substrate, the ABS filament was extruded through a ceramic 125 μm inner diameter tip at 23° C. and patterned layer by layer onto a metallic bed, pre-heated at 11° C. The 3-D surface was then laser-scanned to create a topography mesh that guides the micro-dispensing head to conform to the surface while depositing the conductive parts, as shown in FIG. 1A and in FIG. 3A. In a particular embodiment, the material used for the conductive traces was a silver paste, which possesses a conductivity of ~2e6 S/m once it undergoes a 90° C. drying stage for about 60 minutes. As such, all three processes were realized for forming the 3D tripolar antenna can be accomplished using an 3D tabletop printer comprising an FDM head, a laser displacement sensor and a micro-dispensing head.

Figure 3B:
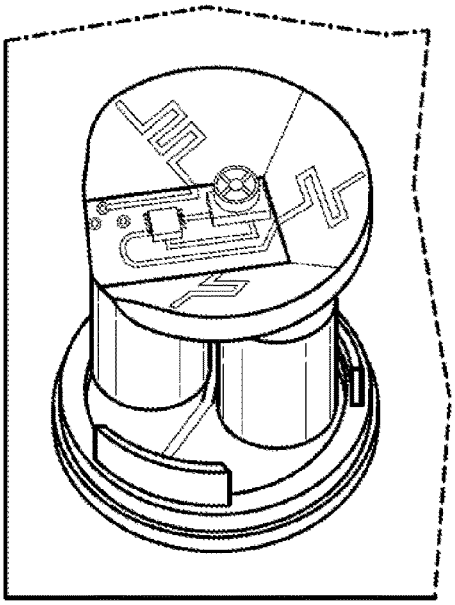
FIG. 3B is a photograph of a fabricated circular antenna prototype, in accordance with an embodiment of the present invention.
Figure 3C:
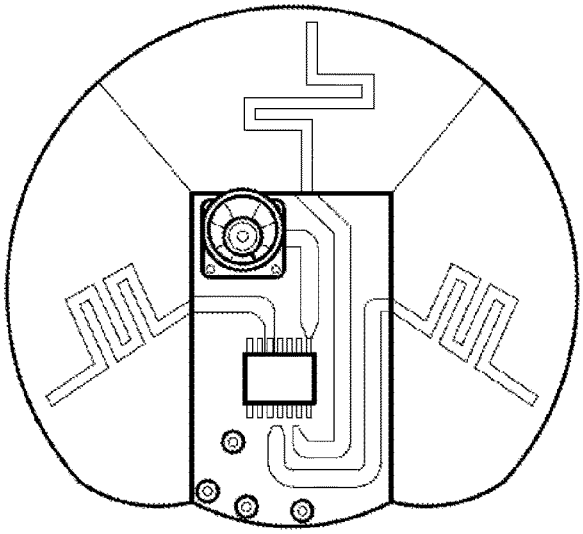
FIG. 3C is a photograph of a fabricate circular antenna prototype on a commercial wireless node, in accordance with an embodiment of the present invention.

FIG. 1B, FIG. 3B and FIG. 3C show the fabricated square and circular antenna prototypes placed on top of the commercial sensor node packages, respectively. As shown, coaxial SMP connectors were used on both prototypes for the RF output signal. The connector and the 3-way switch were manually placed and connected.

In order to demonstrate radiation characteristics and advantages of implementing polarization diversity, each antenna's performance was tested in both anechoic and reflective environments. Transmission and reflection coefficients, along with radiation patterns, and cumulative distributions functions of fading statistics for each polarization state are illustrated and discussed below.

Figure 4A:
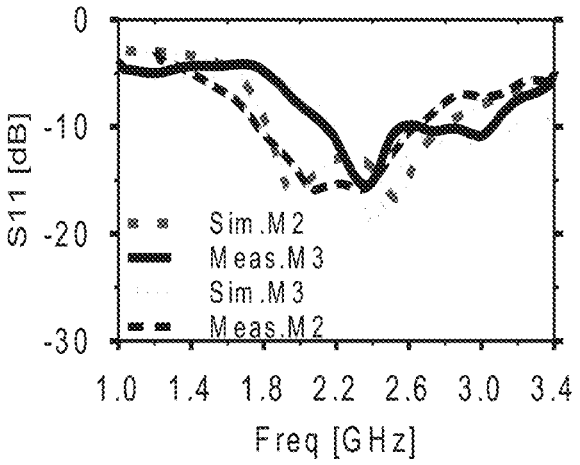
FIG. 4A is an illustration of a simulated and measured 'M2-M3' return loss, in accordance with an embodiment of the present invention.
Figure 4B:
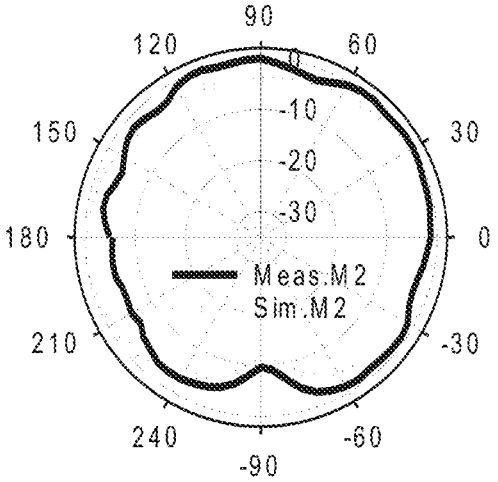
FIG. 4B is a graphical illustration of a 1.0 dB normalized gain pattern (X-Y cut) 'M2', in accordance with an embodiment of the present invention.
Figure 4C:
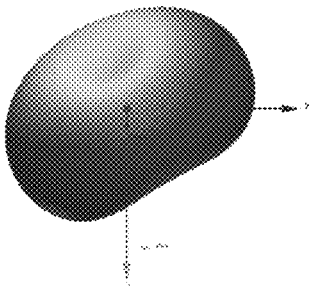
FIG. 4C is a graphical illustration of a simulated 3D gain pattern for each polarization M1, Max gain 2.04 dB, in accordance with an embodiment of the present invention.
Figure 4D:
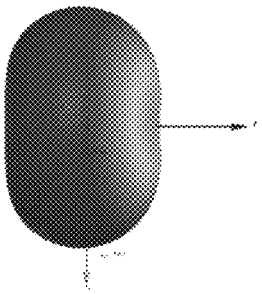
FIG. 4D is a graphical illustration of a simulated 3D gain pattern for each polarization M2, Max gain 2.04 dB, in accordance with an embodiment of the present invention.
Figure 4E:
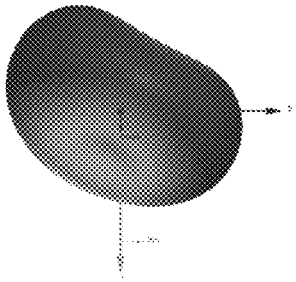
FIG. 4E is a graphical illustration of a simulated 3D gain pattern for each polarization M3, Max gain=2.04 dB, in accordance with an embodiment of the present invention.

The performance of the tripolar antenna system of FIG. 1A was initially measured and characterized in an ideal anechoic environment. FIG. 4A shows the measured and simulated reflection coefficient for the printed monopoles M2-M3, where a return loss greater than 15 dB is obtained at the frequency of 2.4 GHz and a 10 dB bandwidth is achieved from 2.1 GHz to 2.6 GHz. FIG. 4B shows the M2 measured and simulated radiation gain pattern at 2.4 GHz. The data corresponds to the antenna's azimuth plane against a vertically oriented transmitter horn antenna; showing good agreement between the measured and simulated traces. FIG. 4C-FIG. E shows the simulated 3D gain pattern for all three monopoles.

Figure 5A:
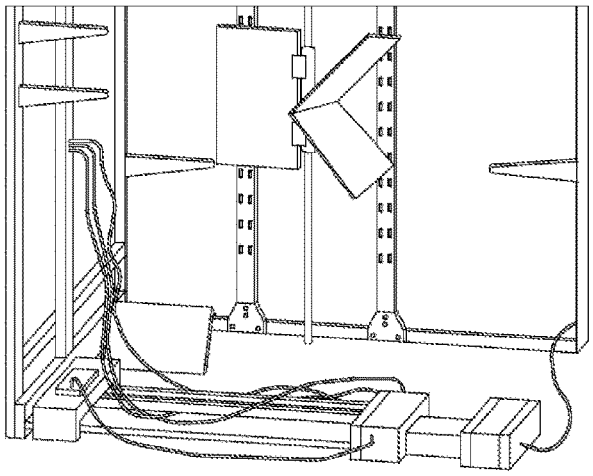
FIG. 5A is an illustration of a compact reverberation chamber.

The anechoic chamber results represent those expected in terms of functionality for an array of monopoles (albeit that the design has these oriented mutually orthogonal in three dimensions). However, in terms of performance of the antenna system for its intended application (i.e., IoT devices in cluttered environments), a more representative environment is required. For this, a compact reverberation chamber capable of emulating channel conditions ranging from benign (i.e., Rician, high K) to very severe (i.e., hyper-Rayleigh), as shows in FIG. 5A, was employed.

Figure 5B:
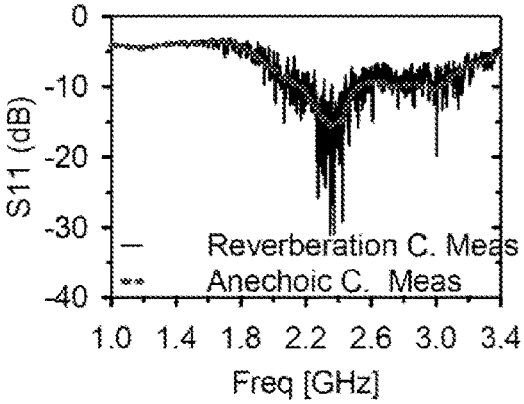
FIG. 5B is a graphical illustration of $S_{11}$ data in the reverberation chamber of FIG. 5A, in accordance with an embodiment of the present invention.

FIG. 5B shows the reflection coefficient of the monopole M3 inside an aluminum reverberation chamber (solid line), where the effects of the multipath environment are clearly distinguishable. The measured return loss strongly depends on the antenna location and conditions inside the chamber, but the complex average value obtained with infinite independent number of stirrer positions will result in the anechoic coefficient shown with the dashed line.

Figure 5C:
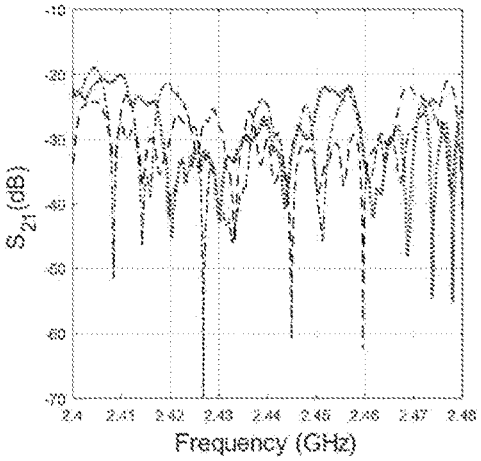
FIG. 5C is a graphical illustration of link loss, i.e., $S_{21}$, for three mutually orthogonal receive elements when transmit element is vertically polarized, in accordance with an embodiment of the present invention.
Figure 5D:
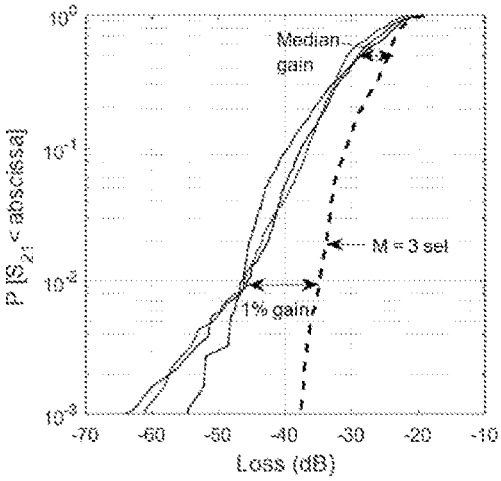
FIG. 5D is a graphical illustration of cumulative distribution function (CDF) plots of $S_{21}$ data for individual elements and when M=3 selection diversity is leveraged, in accordance with an embodiment of the present invention.

With the array placed in the chamber, a vector network analyzer was used to measure $S_{21}$ (i.e., path loss) between a vertically polarized transmit antenna and each element of the receive tripolar array. Measurements, as shown in FIG. 5C, were made at 1840 frequencies in the range of 2.40 GHz to 2.48 GHz. Each element experienced different but statistically similar multipath conditions as illustrated using the cumulative distribution function (CDF) of the $S_{21}$ in FIG. 5D. Also implemented was M=3 selection diversity where the best (i.e., lowest link loss) path was selected for each frequency. The resulting CDF is also shown in FIG. 5D. Implementing this simplest of diversity techniques, readily done using switches and radio signal strength indicator (RSSI) measures found in wireless chipsets, yields median link improvement of 4 dB and 1% link improvement of 11 dB.

Figure 6A:
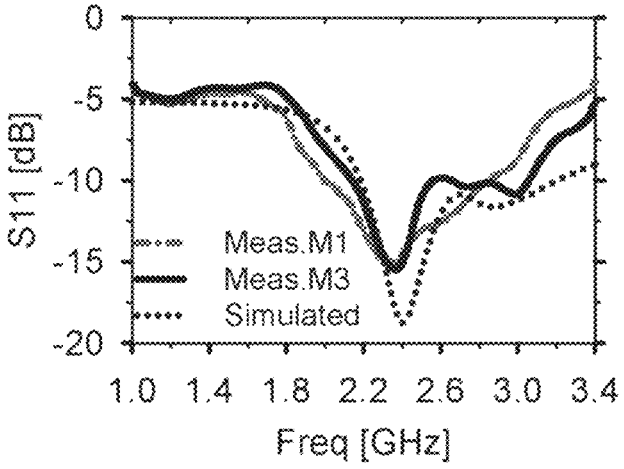
FIG. 6A is an illustration of a square antenna simulated and measured reflection coefficient: M1-M3, in accordance with an embodiment of the present invention.
Figure 6B:
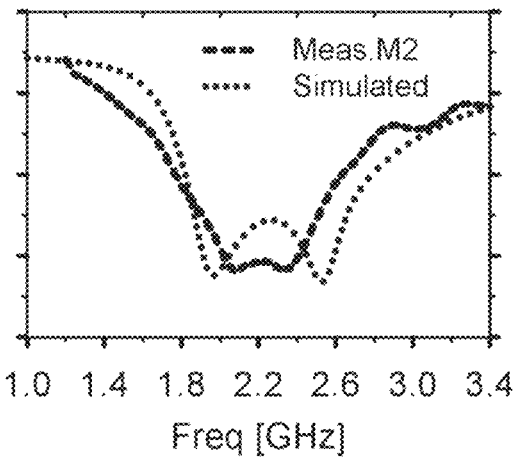
FIG. 6B is an illustration of a square antenna simulated and measured reflection coefficient: M2, in accordance with an embodiment of the present invention.

In an additional simulation of the tripolar rectangular antenna system of FIG. 1A, the performance results are shown in FIG. 6A and FIG. 6B. FIG. 6A illustrates the measured and simulated reflection coefficient of the square antenna for monopoles M1 and M3, both of which are rotated 45° with respect to the Z and X axes. Similarly, FIG. 6B shows the reflection coefficient for monopole M2, which is rotated 45° with respect to the Z axis. In this simulation, return loss is greater than 15 dB at 2.4 GHz on all elements, with a worst case 10 dB bandwidth going from 2.1 GHz up to 2.8 GHz.

Figure 7A:
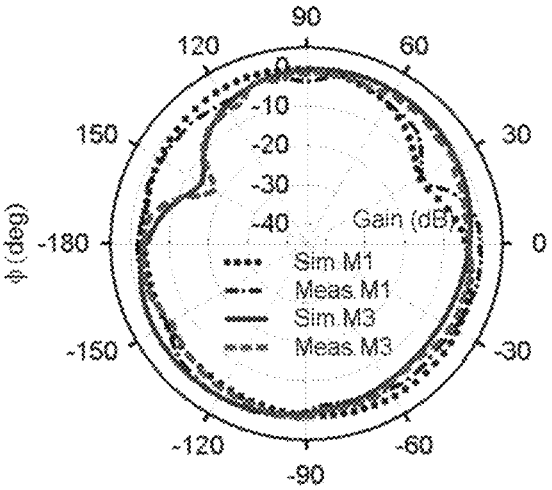
FIG. 7A is an illustration of a square antenna simulated and measured 10 dB normalized gain pattern (X-Y cut): M1-M3 in accordance with an embodiment of the present invention.
Figure 7B:
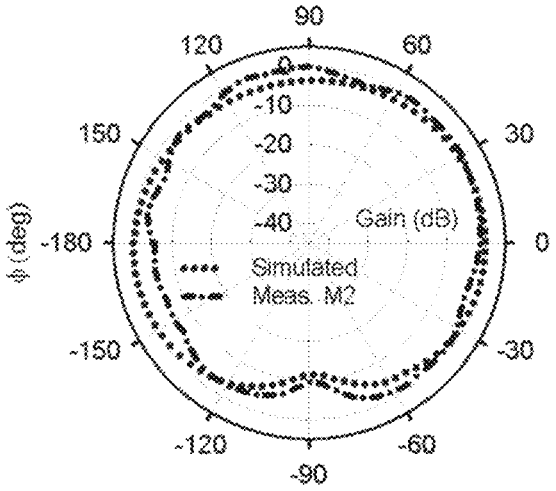
FIG. 7B is an illustration of a square antenna simulated and measured 10 dB normalized gain pattern (X-Y cut): M2, in accordance with an embodiment of the present invention.
Figure 7C:
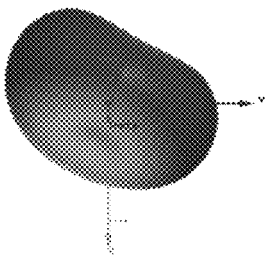
FIG. 7C is an illustration of square antenna simulated 3D gain pattern for an M1 polarization, in accordance with an embodiment of the present invention.
Figure 7D:
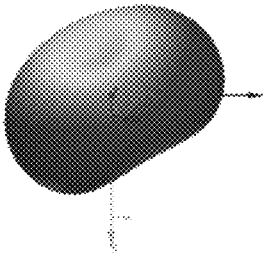
FIG. 7D is an illustration of square antenna simulated 3D gain pattern for an M2 polarization, in accordance with an embodiment of the present invention.
Figure 7E:
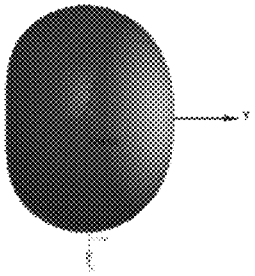
FIG. 7E is an illustration of square antenna simulated 3D gain pattern for an M3 polarization, in accordance with an embodiment of the present invention.

FIG. 7A and FIG. 7B show the measured and simulated gain pattern at 2.4 GHz for monopoles M1, M3 and M2, respectively. The data corresponds to the antenna's azimuth plane against a vertically oriented transmitter horn antenna. That is, the X-Y plane follows the reference axes shown in FIG. 1A and FIG. 2A. FIG. 7C-FIG. 7E show the simulated 3D gain pattern when each individual monopole is selected. It is seen how each pattern null is aligned along the monopole axis, ensuring pattern orthogonality and significant decoupling between the three elements.

Figures 8A, 8B:
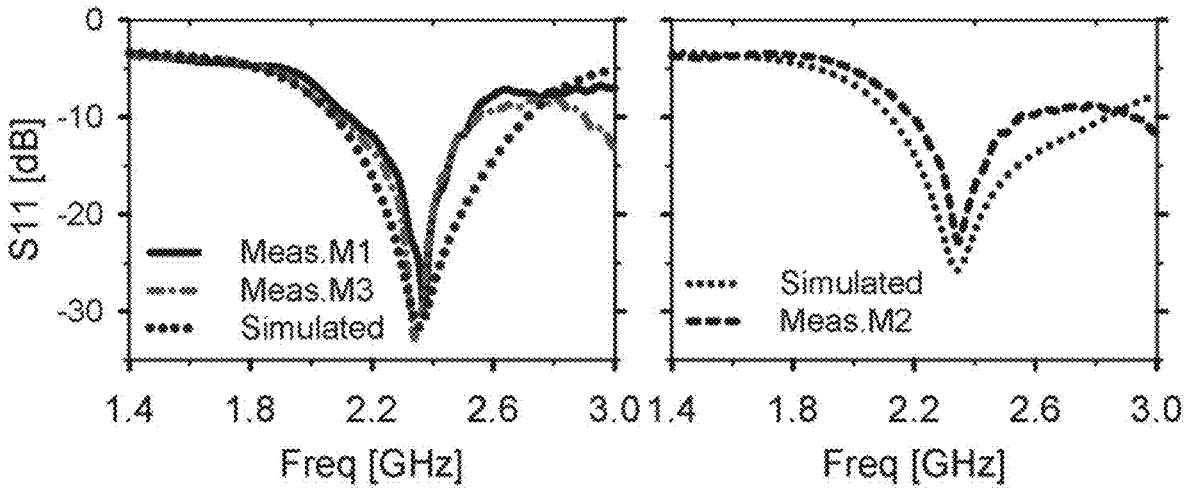
FIG. 8A is an illustration of a circular antenna simulated and measured reflection coefficient: M1-M3, in accordance with an embodiment of the present invention.
FIG. 8B is an illustration of a circular antenna simulated and measured reflection coefficient: M2, in accordance with an embodiment of the present invention.
Figure 9A:
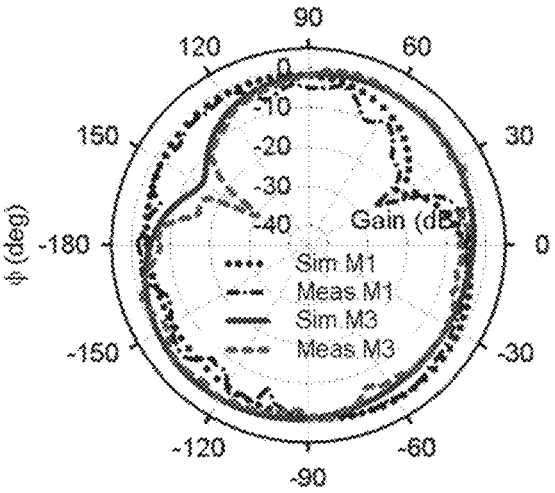
FIG. 9A is an illustration of a circular antenna simulated and measured 10 dB normalized gain pattern (X-Y cut): M1-M3, in accordance with an embodiment of the present invention.
Figure 9B:
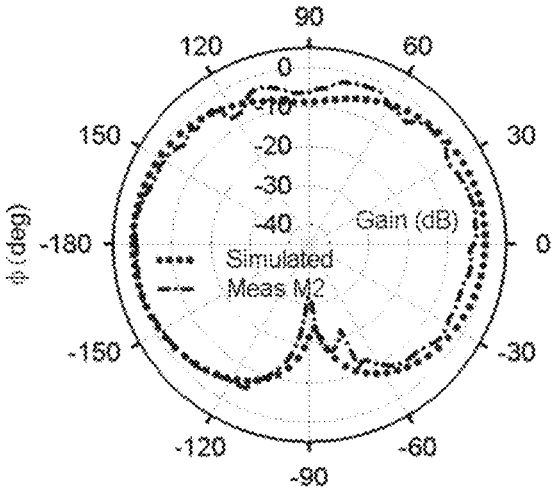
FIG. 9B is an illustration of a circular antenna simulated and measured 10 dB normalized gain pattern (X-Y cut): M2, in accordance with an embodiment of the present invention.
Figure 9C:
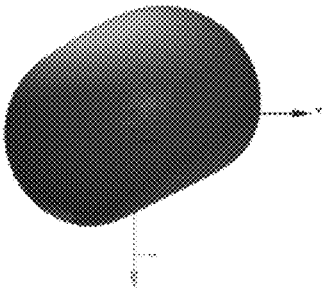
FIG. 9C is an illustration of a circular antenna simulated 3D gain pattern for an M1 polarization, in accordance with an embodiment of the present invention.
Figure 9D:
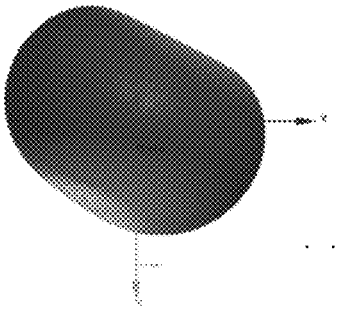
FIG. 9D is an illustration of a circular antenna simulated 3D gain pattern for an M2 polarization, in accordance with an embodiment of the present invention.
Figure 9E:
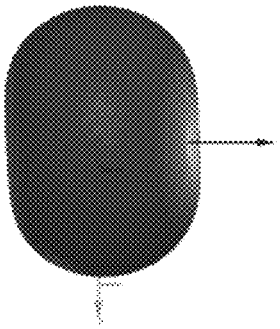
FIG. 9E is an illustration of a circular antenna simulated 3D gain pattern for an M3 polarization, in accordance with an embodiment of the present invention.

Similarly, FIG. 8A and FIG. 8B show the measured and simulated reflection coefficient of the circular antenna of FIG. 2A for the monopoles M1, M3 and M2, respectively. A return loss greater than 20 dB at 2.4 GHz is achieved for all three monopoles, with a worst case 10 dB bandwidth from 2.19 GHz up to 2.56 GHz. FIG. 9A and FIG. 9B show the measured and simulated radiation gain patterns at 2.4 GHz for monopoles M1, M3 and M2, respectively. The data also corresponds to the antenna's azimuth plane against a vertically oriented transmitter horn antenna, showing good agreement between measured and simulated traces. FIG. 9C-FIG. 9E show the simulated 3D gain pattern when each individual monopole is selected. As in the previous design, it is seen how each radiation null is aligned in the direction of the corresponding monopole, ensuring pattern orthogonality and reducing considerably the mutual coupling between arms.

Figure 10:
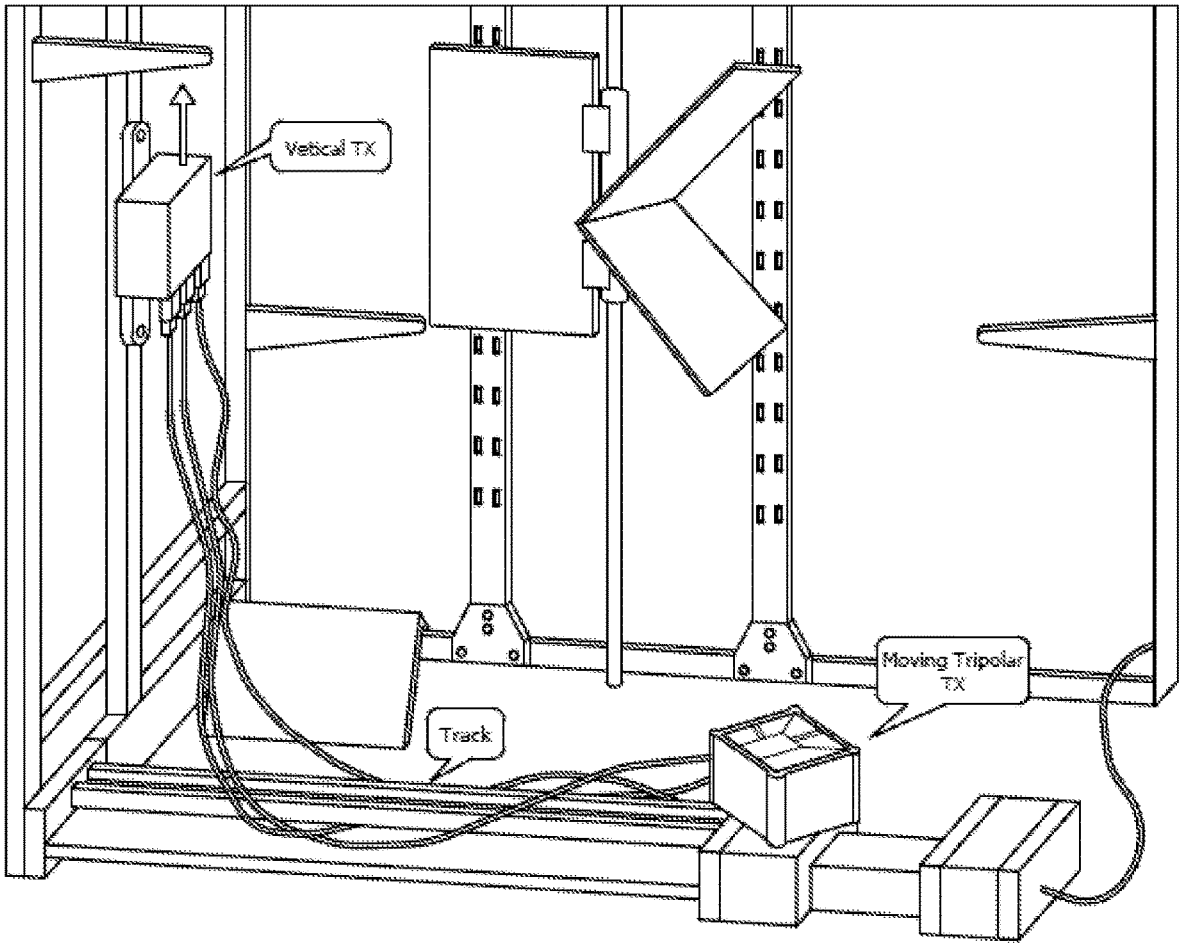
FIG. 10 is an illustration of a test setup inside highly reflective, compact reverberation chamber, in accordance with an embodiment of the present invention.

The anechoic chamber results presented represent those expected in terms of functionality for an array of monopoles (albeit that the present design has these oriented mutually orthogonal in three dimensions). However, in terms of performance of the antenna system for its intended application (i.e., IoT devices in cluttered environments), a more representative test environment is required. For this was employed a compact (0.9 m×0.9 m×0.3 in) reverberation chamber, as shown in FIG. 10, capable of emulating channel conditions ranging from benign (i.e., Rician, high K) to very severe (i.e., two-ray, hyper-Rayleigh). As reverberation chambers have been shown to emulate channel characteristics similar to industrial sites, it was contended that the test environment will similarly emulate conditions that may be seen by M2M systems.

Figure 11A:
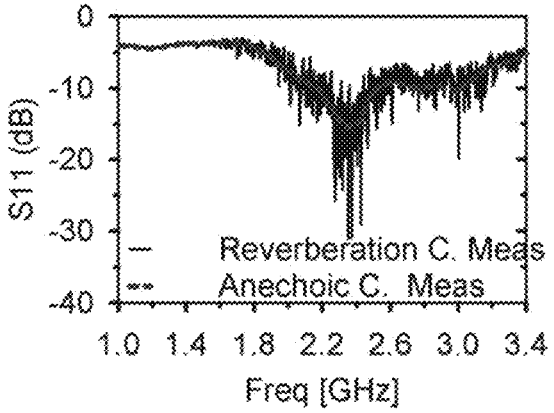
FIG. 11A is an illustration of $S_{11}$ data in reverberation chamber for a square antenna, in accordance with an embodiment of the present invention.
Figure 11B:
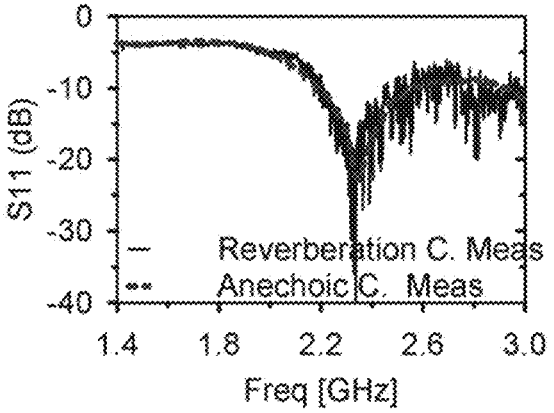
FIG. 11B is an illustration of data in reverberation chamber for a circular antenna, in accordance with an embodiment of the present invention.

FIG. 11A and FIG. 11B show the reflection ($S_{11}$) coefficient for the monopoles M3'Square' and M2'Circular', respectively, inside an aluminum reverberation chamber (solid line) for a fixed stirrer position. It is seen that although the measured return loss is strongly affected by the antenna placement and conditions inside the chamber, the impedance match is still preserved at 2.4 GHz, moreover the overall frequency response follows the trend of the anechoic coefficient shown with the dashed line.

With each individual tripolar array mounted on a controlled linear track that allows positioning to one of 50 repeatable locations in 1 cm (i.e., $<\lambda/10$) increments, a vector network analyzer was used to measure $S_{21}$ (i.e., path loss) between a vertically polarized (i.e., Z-oriented) transmit antenna and one element of the receive tripolar array.

Figure 12A:
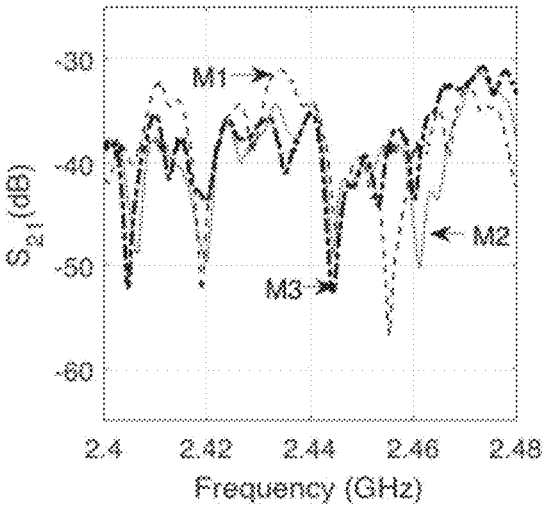
FIG. 12A is an illustration of square antenna results showing link loss, i.e., $S_{21}$, for three mutually orthogonal receive elements, when transmit element is vertically polarized, in accordance with an embodiment of the present invention.

The measurements, shown in FIG. 11A and in FIG. 12A, were made at 551 frequencies in the range of 2.40 GHz to 2.48 GHz and at 50 positions inside the chamber. It is seen that for the square antenna, the individual links have comparable characteristics with median losses ranging from approximately 39.7 to 40.3 dB. Thus, over 25,000 test conditions, it was found that no single element (M1, M2, or M3) exhibit any superior performance over the other two.

Figure 12B:
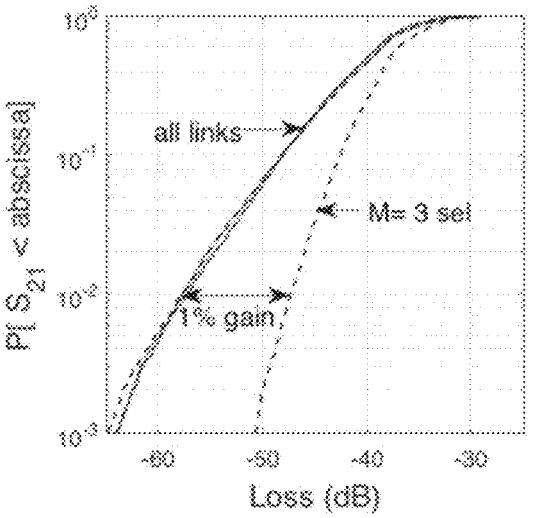
FIG. 12B is an illustration of square antenna results showing cumulative distribution function (CDF) plots of $S_{21}$ data for individual elements and when M=3 selection diversity is leveraged, wherein 1% link improvement is found to be ~11 dB, in accordance with an embodiment of the present invention.

Also implemented was M=3 selection diversity, where the best (i.e., lowest link loss) path was selected for each frequency. The resulting CDF is seen in FIG. 12B. Implementing this simplest of diversity techniques, readily done using switches and radio signal strength indicator (RSSI) measures found in wireless chipsets, yields 1% link improvement of 11 dB. This value is significant in that it could be traded for reducing transmit power by an order of magnitude, thereby saving node energy and extending battery life or be leveraged to reduce the link outage probability and/or BER (as is later demonstrated).

Figure 13A:
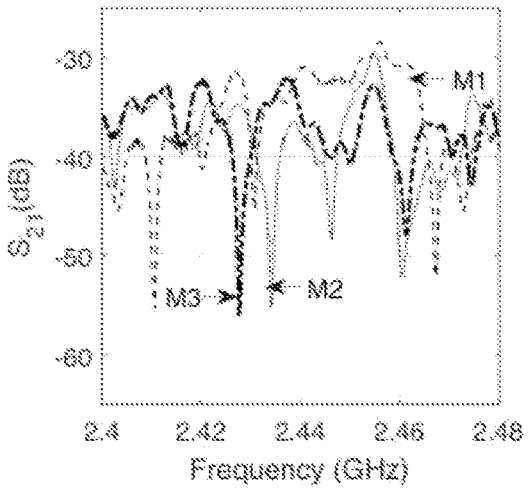
FIG. 13A is an illustration of circular antenna results showing link loss, i.e., $S_{21}$, for three mutually orthogonal receive elements when transmit element is vertically polarized, in accordance with the present invention.

The results obtained from the circular antenna show that the individual links have comparable characteristics with median $S_{21}$ ranging from approximately −36 to −37.5 dB. Employing selection diversity among the three elements improves the 1% link margin by 14 dB, as shown in FIG. 13A, a significant improvement in overall link characteristics.

Transmission over a link in a wireless network is prone to error due to noise and multipath effects. Bit error rate (BER) is often used to evaluate the link quality. BER has also been employed as a performance metric for routing protocols in wireless sensor networks.

Figure 14:
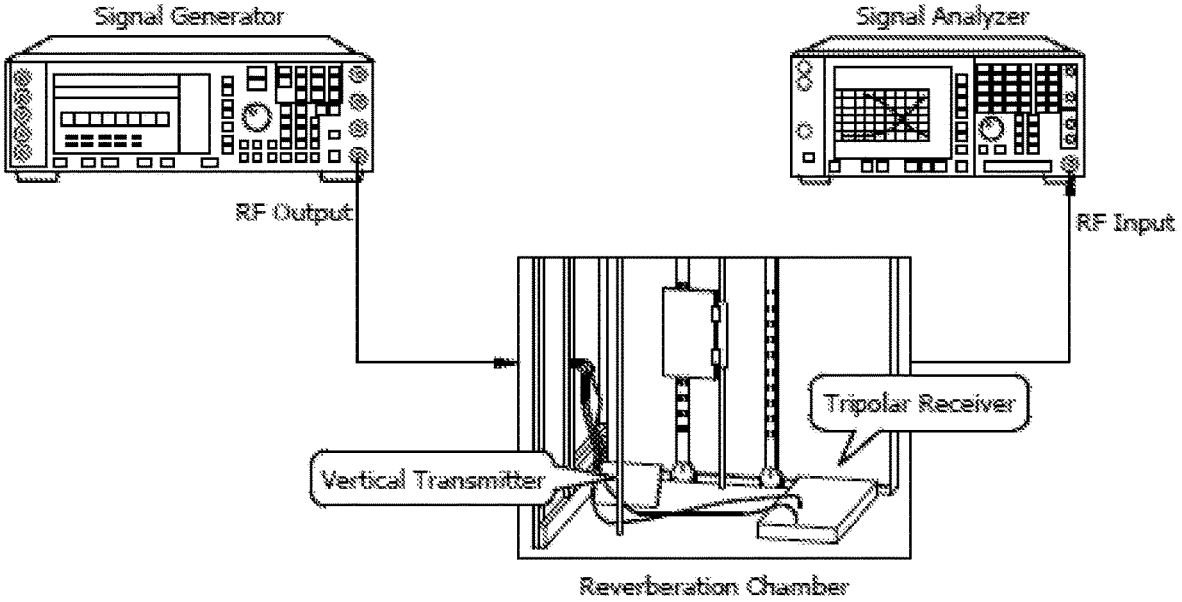
FIG. 14 is an illustration of a test setup for BER measurements, in accordance with an embodiment of the present invention.

To understand how the tripolar antenna system might improve BER in very harsh environments, over-the-air BER measurements were performed in the reverberation chamber. The measurement setup for obtaining the BER is shown in FIG. 14. Unlike the previous $S_{21}$ over-the-air measurements that were taken at 50 locations and 551 distinct frequencies, the BER measurements were conducted for one configuration of transmit and receive antenna array and at 16 channels with bandwidths of 375 kHz in the range of 2.4 GHz to 2.48 GHz. A vector signal generator was used to generate BPSK modulated signals with symbol rate of 250 kb/s. To receive and demodulate the signals, a vector signal analyzer was employed.

Figure 13B:
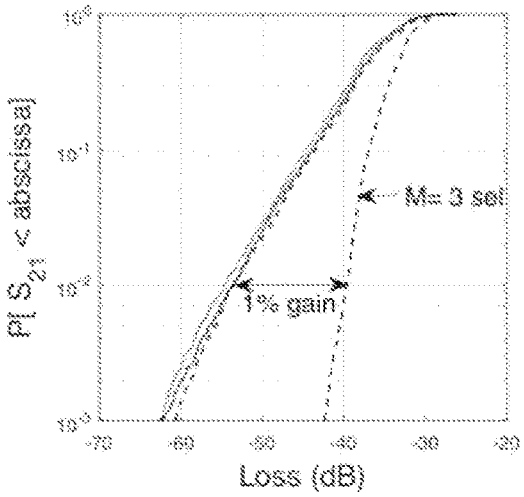
FIG. 13B is an illustration of circular antenna results showing cumulative distribution function (CDF) plots of $S_{21}$ data for individual elements and when M=3 selection diversity is leveraged, wherein 1% link improvement is found to be ~14 dB, in accordance with an embodiment of the present invention.
Figure 15:
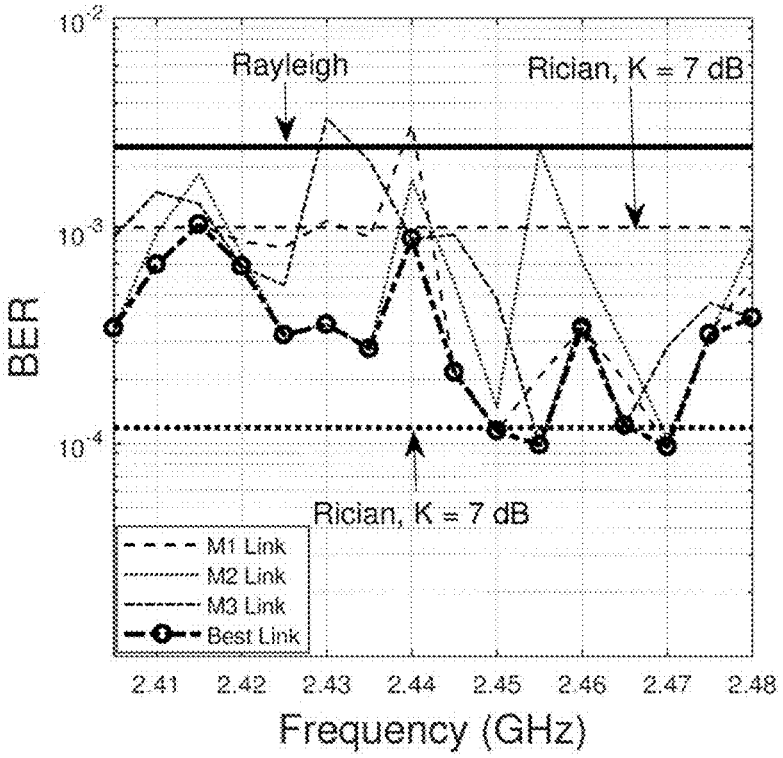
FIG. 15 is an illustration of the BER of three links and the best link of the square tripolar antenna, in accordance with an embodiment of the present invention.
Figure 16:
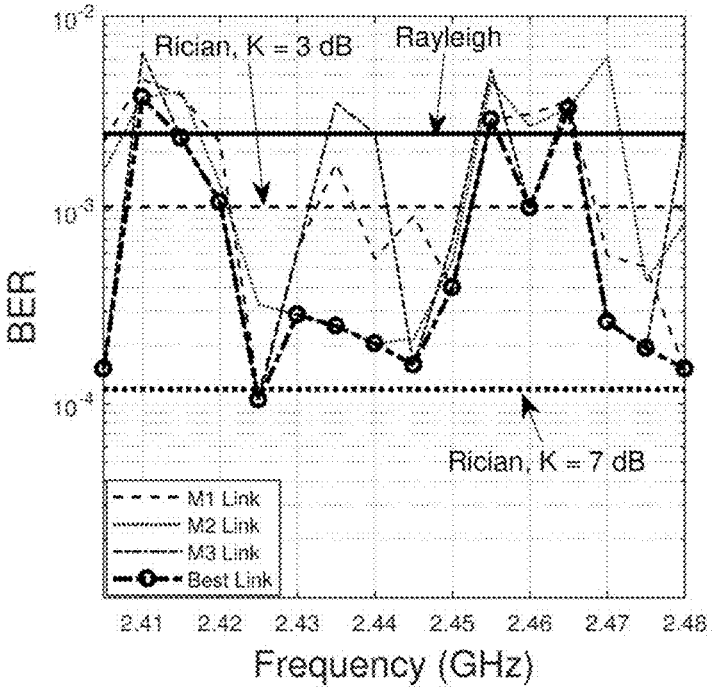
FIG. 16 is an illustration of the BER of three links using the circular tripolar antenna, in accordance with an embodiment of the present invention.

In order to measure the BER, the received bits were compared with transmitted bits. These measurements were made 1000 times. The BER graphs at $E_b/N_0$=20 dB for three antenna links over channel frequency, which are presented in FIG. 13B, indicate frequency selectivity of the channel. Theoretical BER values for Rayleigh channel and Rician channels with two different K values are plotted in order to see qualitative effects. The lowest BER among three links is selected at each frequency and shown in FIG. 15. The data are summarized in Table I. It is found that employing diversity methods for this particular measurement scenario decreased the average BER by 42% compared to leveraging just any single element. The same BER measurements were repeated for the circular antenna. Based on the data presented in FIG. 16 and Table II, the average BER decreased by 44% when employing the tripolar antenna. It should be noted that the nominal $E_b/N_0$=20 is a relatively robust channel and that improvement can be expected to be greater at lower $E_b/N_0$ values.

TABLE I

| Statistics of BER of square tripolar antenna | | | |
|---|---|---|---|
| Link | Min | Mean | Max |
| M1 | 9.6e−5 | 7.0e−4 | 3.2e−3 |
| M2 | 1.1e−4 | 7.6e−4 | 2.4e−3 |
| M3 | 9.8e−5 | 9.2e−4 | 3.4e−3 |
| Best | 9.6e−5 | 4.0e−4 | 1.1e−3 |

TABLE II

| Statistics of BER of circular antenna links | | | |
|---|---|---|---|
| Link | Min | Mean | Max |
| M1 | 1.1e−4 | 1.8e−3 | 4.7e−3 |
| M2 | 2.0e−4 | 1.9e−3 | 6.2e−3 |
| M3 | 1.0e−4 | 1.9e−3 | 6.5e−3 |
| Best | 1.0e−4 | 1.0e−3 | 3.8e−3 |

The $S_{21}$ measurements and BER data have shown experimentally that the prototype tripolar antennas of the present invention provide an effective means of mitigating frequency and space dependent multipath effects in highly reflective communication environments. In addition, the antenna system can be integrated with commercial wireless sensor hardware to demonstrate system-level improvements. The metric for demonstrating improvements is the received strength signal indicator (RSSI), a normalized power value in dB that is available from most modern wireless chipsets. The RSSI value can infer path loss as it provides a relative dB value of the signal strength over a link. As noted at the onset, the prototype antenna systems were physically designed to be integrated with commercial wireless sensor nodes. The nodes in mind during the development include an accelerometer sensor for the square antenna and a displacement sensor for the circular design.

In the demonstration, RSSI data was captured using the square antenna, integrated with firmware from a sensor gateway/basestation. The firmware was developed and the experiment was run using a standard development board. The board was designed to operate at 2.4 GHz with a maximum power of 13 dBm. A test script was then written using an open source library associated with the sensor. The script successively pings the node 50 times, saves the average RSSI value, repeats the process for each antenna element, and then repeats the process for each channel frequency within a specific range.

Figure 17:
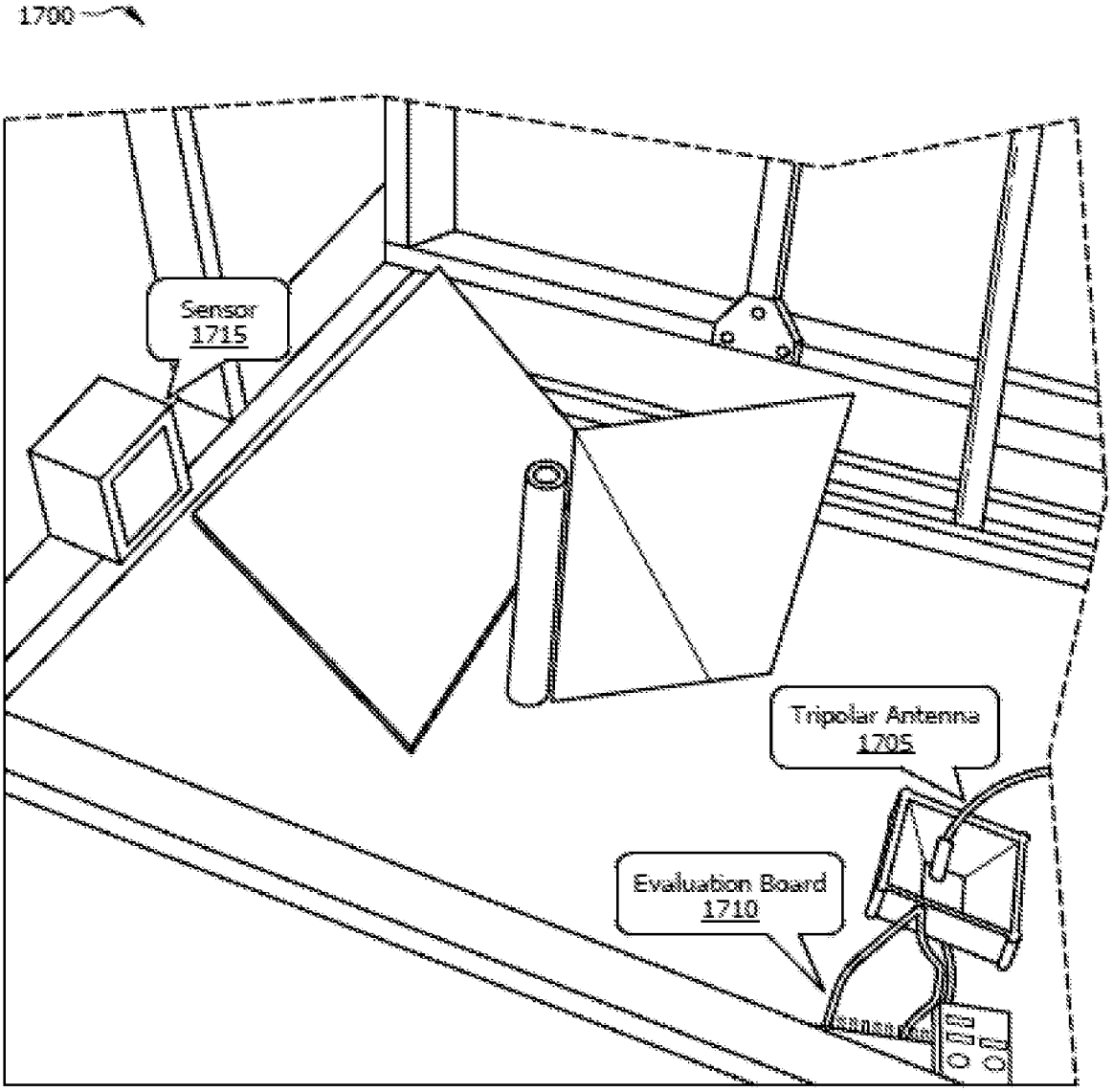
FIG. 17 is an illustration of the set-up for the RSSI experiments, wherein the LORD G-Link2 is present on the left of the chamber, while the tripolar is on the right, with the LOS component blocked, in accordance with an embodiment of the present invention.
Figure 18:
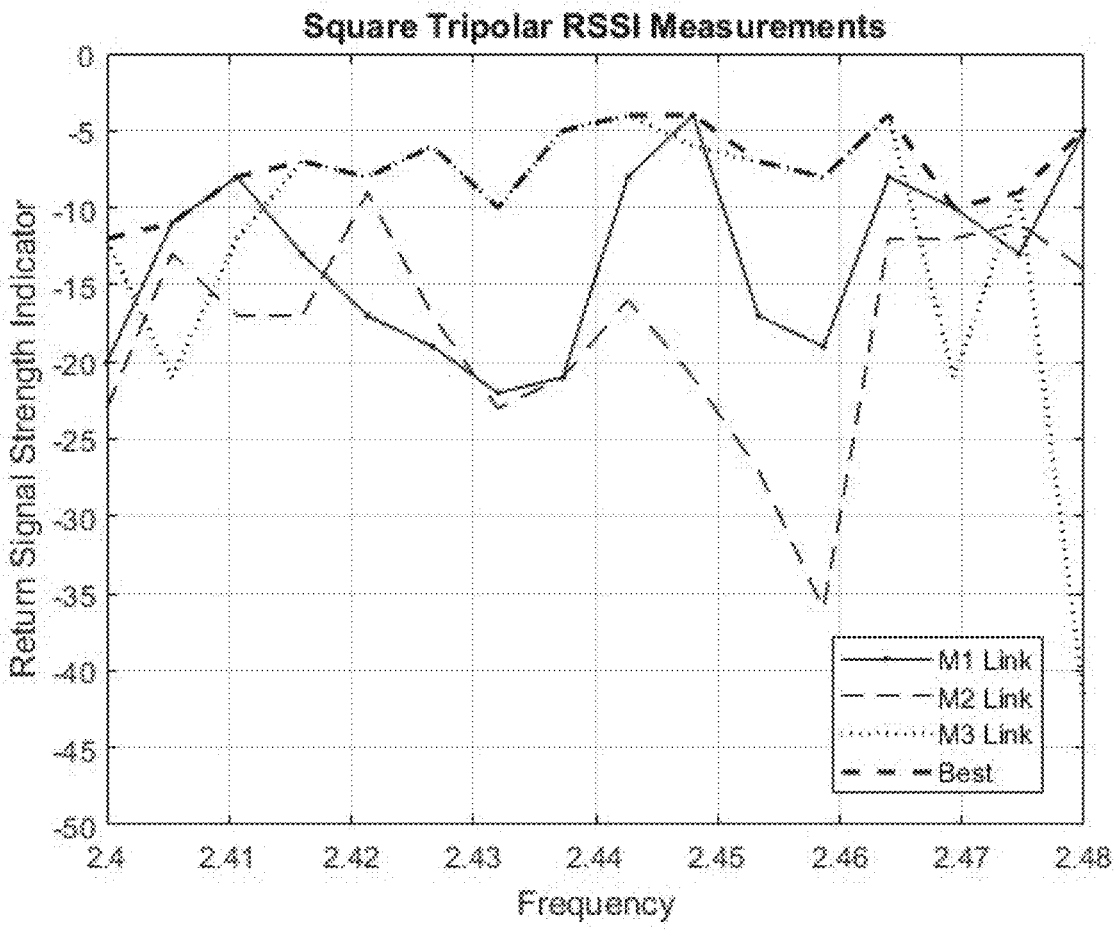
FIG. 18 is an illustration of the RSSI data captured within the reverberation chamber. The measurements taken at each antenna element are displayed, along with the 'best' scenario that could be attained with selection diversity, in accordance with an embodiment of the present invention.

With reference to FIG. 17, in an experimental embodiment 1700, the tripolar antenna 1705 was placed in the reverberation chamber, connected to the development board 1710 with the basestation firmware and a link was established with a sensor 1715, with the line-of-sight blocked. Applying selection diversity using this tripolar antenna improves the RSSI measurements substantially, as shown in FIG. 18, with the supporting statistics displayed in Table III. From Table III it can be seen that selection diversity between the three antenna elements improves the median RSSI 10 dB from the "worse" performing antenna element (M2). Selection diversity also provides "flatter" (i.e., more consistent) performance across the channels, as shown in FIG. 18, as there is between 3 to 6 dB decrease in standard deviation when compared to the individual elements.

TABLE III

| RSSI Data (Square Antenna System) | | |
|---|---|---|
| Link | Median | Standard deviation |
| M1 | −13 dB | 5.93 dB |
| M2 | −17 dB | 6.94 dB |
| M3 | −8 dB | 9.66 dB |
| Best | −7.5 dB | 2.59 dB |

In accordance with the present invention, two distinct 3D printed tripolar antennas have been developed and characterized for operation at 2.4 GHz, each antenna was fabricated through additive manufacturing techniques to match the geometries of commercial wireless node packages. The antenna systems were designed to mitigate harsh channel conditions by implementing polarization diversity between three mutually orthogonal ~λ/4 monopoles. Performances where demonstrated under ideal and high multipath conditions, showing return loss values greater than 15 dB at the frequency of interest. Over the air testing demonstrated a 1% channel improvement of up to 14 dB across over 500 locations in a multipath environment and 44% reduction in BER at a representative location. Additionally, full integration with commercial hardware was performed resulting in the antenna array's capability for providing more consistent conditions over all selectable communication frequencies/channels. Future work includes developing on-chip mm-Wave multipolar antenna systems fabricated with additive manufacturing and laser machining to diminish depolarization effects present in wireless chip-to-chip communication channels.

Figure 19A:
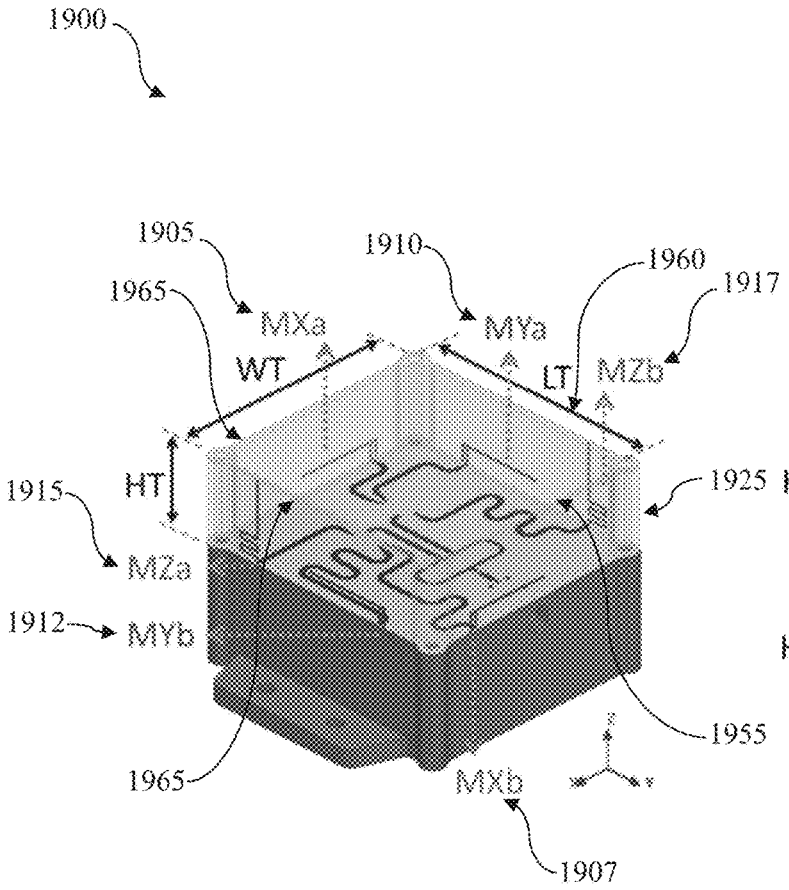
FIG. 19A is an illustration of the tripolar system design, wherein the 3 monopole pairs are labeled as MXa/MXb, MYa/MYb, MZa/MZb, in accordance with an embodiment of the present invention.

In an additional embodiment, shown in FIG. 19A, a tripolar antenna system 1900 in accordance with the present invention includes pairs of X-, Y- and Z-oriented monopoles on opposing sides of a 3D package 1925, which are connected to microwave switches to enable selection of individual monopole pairs. In this embodiment, an X-oriented monopole pair includes a first X monopole MXa 1905 and a second X monopole MXb 1907, wherein MXa 1905 is positioned on a first side 1950 of the 3D package 1925 and MXb 1907 is positioned on a second side 1955 that is opposite to the first side 1950. Additionally, the tripolar antenna system 1900 further includes a Y-oriented monopole pair which includes a first Y monopole MYa 1910 positioned on a third side 1960 and a second Y monopole MYb 1912 positioned on a fourth side 1965, wherein the third side 1960 is opposite the fourth side 1965. The tripolar antenna system 1900 further includes a Z-oriented monopolar pair which includes a first Z monopole MZa 1915 positioned on the fourth side 1965 and a second Z monopole MZb 1917 positioned on the third side 1960, wherein the third side 1960 is opposite the fourth side 1965.

TABLE IV

| DIMENSIONS OF THE ANTENNA DESIGNS | | | | | |
|---|---|---|---|---|---|
| Variable | mm | Var. | mm | Var. | mm |
| HT | 21.01 | WT | 60.11 | LT | 64.94 |
| Hz1 | 14.00 | Hz2 | 05.00 | Wz | 05.50 |
| Lxy1 | 20.50 | LxY2 | 01.50 | Hxy | 05.00 |

Figure 19B:
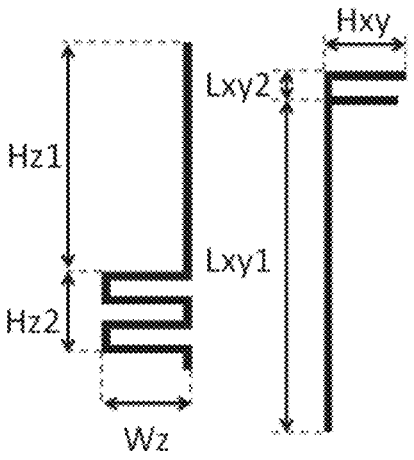
FIG. 19B is an illustration of antenna geometries for the 3 monopole pairs of the tripolar system design, in accordance with an embodiment of the present invention.
Figure 20A:
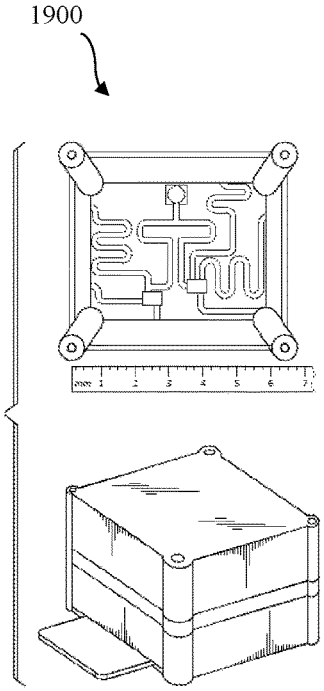
FIG. 20A is an illustration of a fabricated antenna system on top of a commercial package, in accordance with an embodiment of the present invention.
Figure 20B:
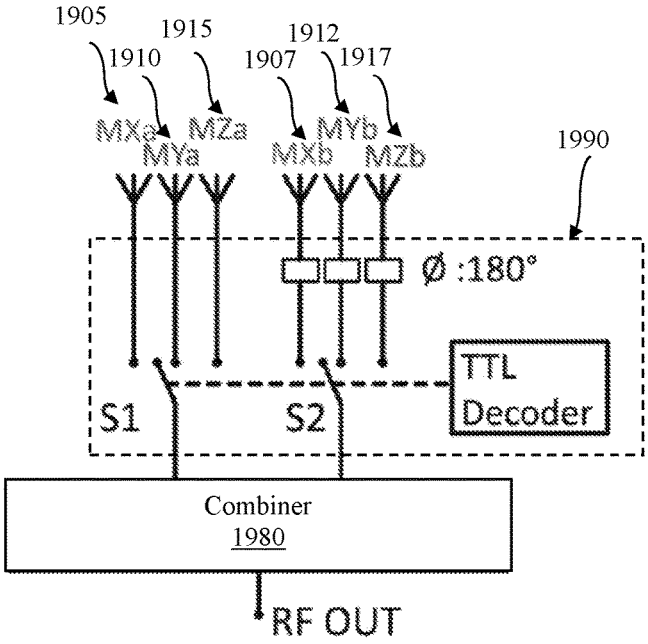
FIG. 20B is an illustration of a switching diagram, in accordance with an embodiment of the present invention.

The details of the 2.4 GHz antenna design of FIG. 19A are provided in Table IV, which the dimensions illustrated in FIG. 19B. In this embodiment, an inverted-F antenna was selected for the X and Y polarizations, using a parallel stub to ground for inductive loading and impedance matching. Each pair of X and Y elements is oriented in opposite directions, and separated by ~/2, creating a two-element broadside array. The Z-oriented polarization on the other hand, consists of two meandered /4 monopoles. Additionally, all elements 1905, 1907, 1910, 1912, 1915 and 1917 are fed through a power combiner 1980 and electronic switching 1990 with 180° phase difference as shown in FIG. 20B. The 180° phase difference is achieved by meandering the feedline connecting to one element in each pair. In this embodiment, the antennas and feed network are printed on 1.5 and 0.5 mm thick acrylonitrile butadiene styrene (ABS) substrates, respectively, with r of 2.6 and tan of 0.0058 at 1 GHz. FIG. 20A shows the fabricated prototype where the combiner, switches and uniform/meandered feedlines are visible.

In this exemplary embodiment, the package with integrated antennas was fabricated using an 3D tabletop printer, which included an FDM head for depositing the ABS, with a minimum layer thickness of ~75 μm and typical surface roughness of 5-7 microns. The printer also included a micro-dispensing head on the same gantry that was used to deposit the silver paste. The typical paste thickness was 25 μm and the conductivity was ~2e6 S/m. The ABS plastic was deposited on a heated bed (90° C.) and the silver paste was dried at ~90° C. In this preliminary design, pieces of the package were printed separately and post assembled into the 3D form factor (64×60×21 mm3). Future designs will use a curved upper surface and leverage the conformal capability of the printer to enable single-piece construction, as in the previously described designs.

Figure 21A:
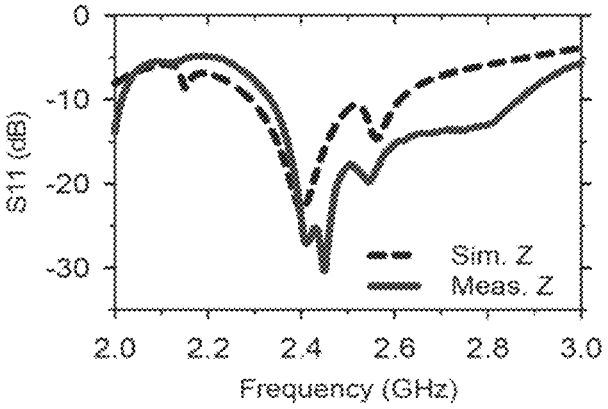
FIG. 21A is an illustration of the simulated and measured $S_{11}$ for the Z oriented monopoles, in accordance with an embodiment of the present invention.
Figure 21B:
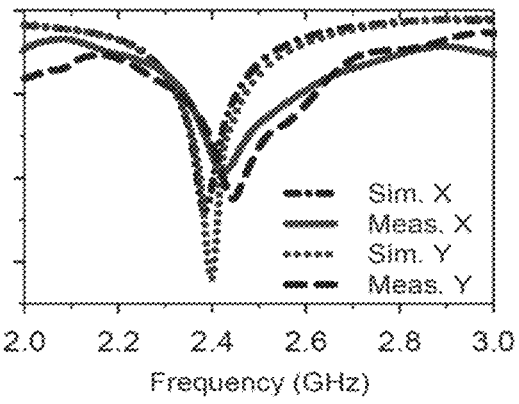
FIG. 21B is an illustration of the simulated and measured $S_{11}$ for the X-Y oriented monopoles, in accordance with an embodiment of the present invention.
Figure 21C:
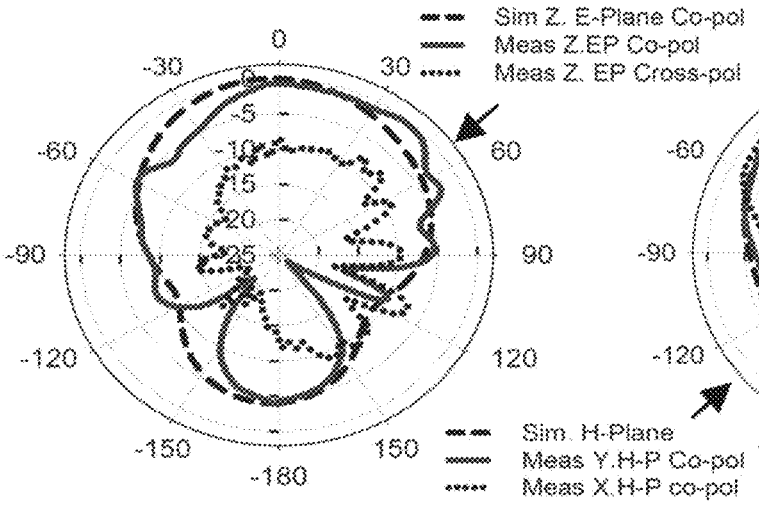
FIG. 21C is an illustration of the measured normalized radiation patterns for the Z oriented monopoles, in accordance with an embodiment of the present invention.
Figure 21D:
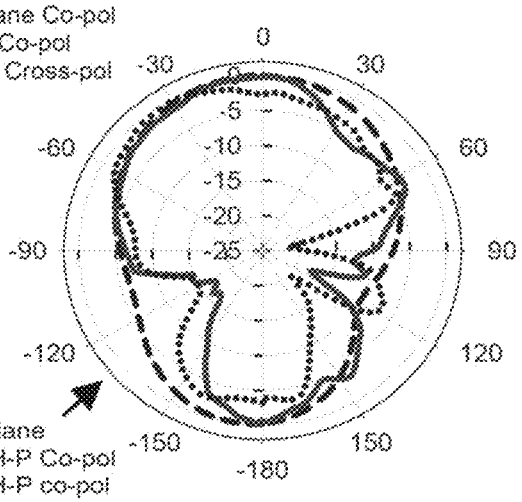
FIG. 21D is an illustration of the measured normalized radiation patterns for the X-Y oriented monopoles, in accordance with an embodiment of the present invention.

FIG. 21A shows the data for the Z oriented monopoles. FIG. 21B shows the $S_{11}$ data for the X-Y oriented monopoles, with a return loss at 2.4 GHz that is greater than 17 dB in all cases. FIG. 21C is an illustration of the measured normalized radiation patterns for the Z oriented monopoles and FIG. 21D is an illustration of the measured normalized radiation patterns for the X-Y oriented monopoles.

To further demonstrate the performance of the tripolar design, channel loss was measured between each of its three mutually orthogonal elements and a vertically polarized (i.e., Z-direction) transmit antenna within a highly-reflective environment. The $S_{21}$ data shown illustrates the significant frequency-selectivity seen in all three paths due to the multipath caused by the environment. Note that these data correspond to a particular antenna placement and any position change could create significantly different $S_{21}$ results.

Figure 22A:
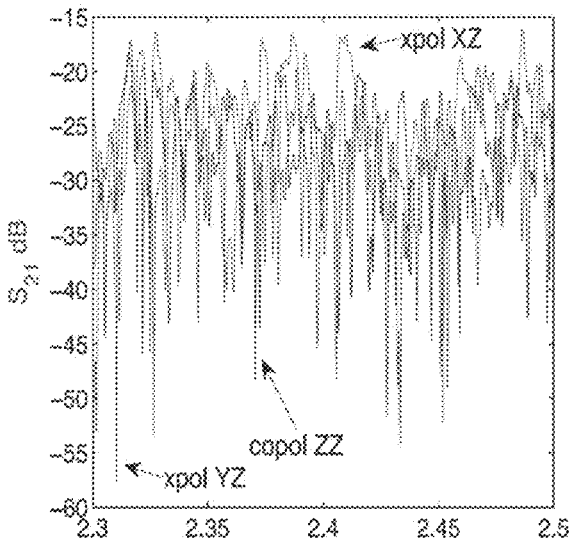
FIG. 22A is an illustration of $S_{21}$ data for the co-polarized and two cross-polarized links, in accordance with an embodiment of the present invention.
Figure 22B:
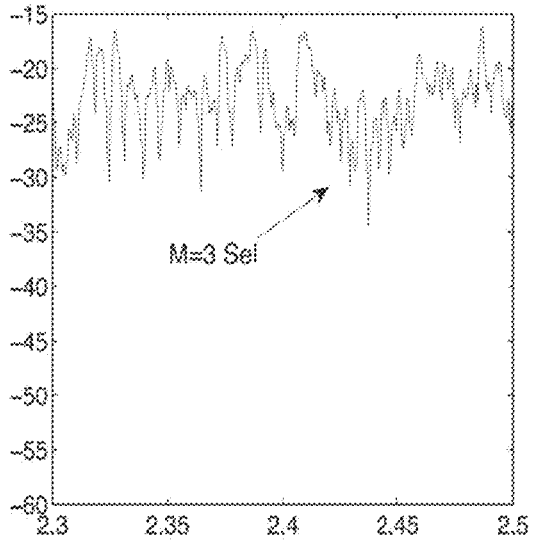
FIG. 22B is an illustration of an ability of tripolar design to "flatten" the channel of FIG. 22A using M=3 selection diversity, in accordance with an embodiment of the present invention.

It is noted that the median $S_{21}$ value, −26.9 dB, of the co-polarized link is not dissimilar from that of the two cross-polarized links: −27.3 dB and −25.8 dB, for XZ and YZ, respectively. This low cross polarization discrimination indicates the significant depolarization across all three spatial dimensions caused by the environment and motivates the use of an antenna that can adapt to these conditions. FIG. 22A is an illustration of $S_{21}$ data for the co-polarized and two cross-polarized links and FIG. 22B is an illustration of an ability of tripolar design to "flatten" the channel of FIG. 22A using M=3 selection diversity, in accordance with an embodiment of the present invention.

Figure 23:
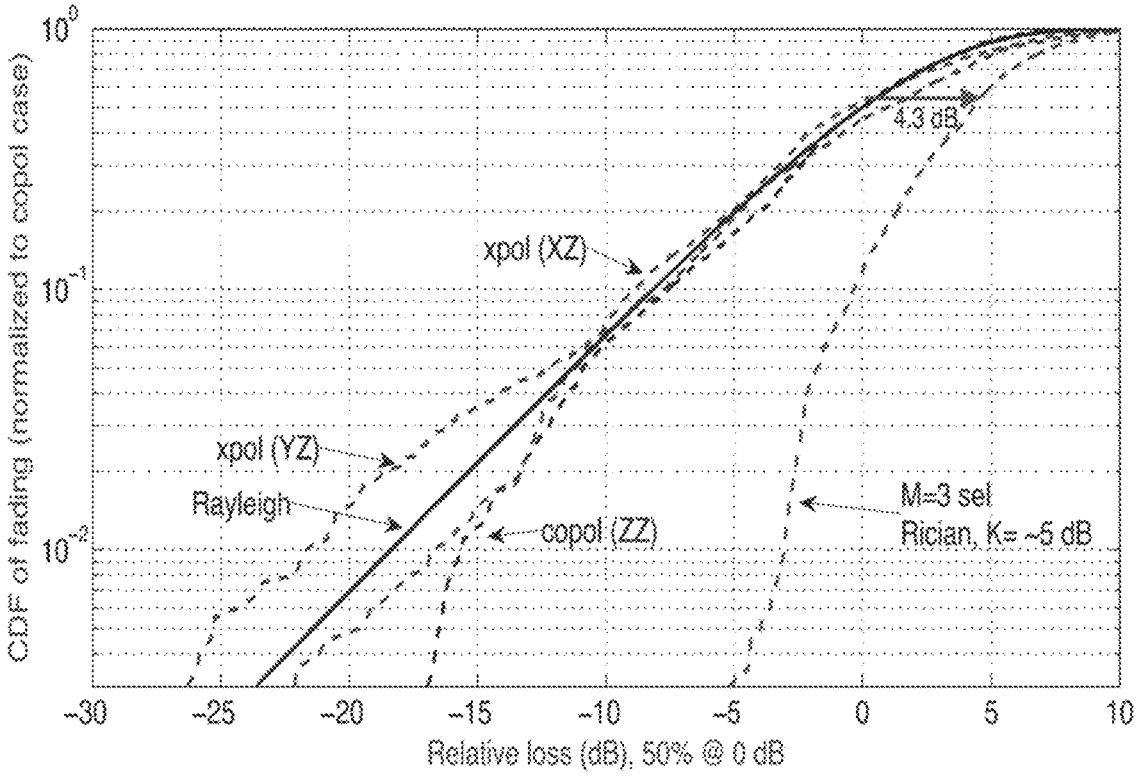
FIG. 23 is an illustration of the channel statistics for each element of the array (normalized to co-pol) and benefits of selection diversity, wherein median improvement seen to be 4.3 dB in addition to link reliability gains, in accordance with an embodiment of the present invention.

A straightforward means of adaptation, and one that can be implemented by low-complexity M2M wireless chipsets, is that of selection diversity. FIG. 22B illustrates how this technique can "flatten" the channel and improve the overall loss to a median value of −22.6 dB, a 4.3 dB improvement over the co-pol result. A further benefit of implementing diversity methods is in improving the overall channel statistics. FIG. 23 shows the channel cumulative distribution function for each of three links and also that for when M=3 selection diversity is employed.

The constituent links all exhibit Rayleigh-like statistics whereas leveraging the antenna's adaptability results in a more benign, K≅5 dB, Rician channel. Whereas there is a 1% chance of a 15 dB or greater signal drop (relative to the median $S_{21}$) when using any of one of the antenna's elements, this impairment is reduced to ~3 dB using selection diversity. The mitigated system is thus one where potentially the devices could transmit at lower power to save energy without compromising link reliability. Note that these $S_{21}$ data correspond to the particular location the tripolar antenna was placed in the environment. Slight changes in location (~λ/10) can result in significant changes in $S_{21}$ and resulting channel statistic, thus further emphasizing the need for an antenna system that can adapt to device placement or dynamic environments.

As such, in this embodiment a 3D tripolar antenna has been developed for operation at 2.4 GHz. Each polarization is controlled by electronic switching and consists of a two-element array of inverted F antennas or meandered monopoles for broadside radiation. The compact system was specifically designed to integrate with a commercial wireless sensor node.

Antenna performance was demonstrated under ideal anechoic conditions but more importantly in a harsh multipath and depolarization environment where it was shown to effectively mitigate these effects with little added complexity to the system design.

Accordingly, in the various embodiments of the present invention, a 2.4 GHz additive manufactured 3D tripolar antenna system is provided for integration with a commercial wireless sensor node. The system switches between three mutually-orthogonal λ/4 monopoles to achieve distinct polarization states, improving link reliability significantly through selection diversity.

Components of the present invention may be embodied utilizing various computing platforms that perform actions responsive to software-based instructions. For example, software-based instructions may be implemented for measuring the radio signal strength to be used by the radio signal strength indicator (RSSI) and the switch to implement polarization diversity between the three mutually orthogonal λ/4 monopole antenna. The following provides an antecedent basis for the information technology that may be utilized to enable the invention.

A computer readable medium for storing the software-based instructions may be a computer readable signal medium or a computer readable storage medium. The computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any non-transitory, tangible medium that can contain, or store a program for use by or in connection with an instruction execution system, apparatus, or device.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described.

What is claimed is:

1. A 3D tripolar antenna system, the system comprising:

a 3D dielectric substrate comprising a substantially flat bottom dielectric substrate and at least three sloped dielectric substrate walls extending from the flat bottom dielectric substrate;

three mutually orthogonal λ/4 monopole antenna, each one of the three mutually orthogonal λ/4 monopole antenna printed on a different one of the sloped dielectric substrate walls; and a microstrip line printed on the substantially flat bottom dielectric substrate and connected to each of the three mutually orthogonal λ/4 monopole antenna.

2. The system of claim 1, further comprising a switch coupled to the microstrip line, the switch for selecting one of the three mutually orthogonal λ/4 monopole antenna.

3. The system of claim 2, wherein the system further comprises a radio signal strength indicator (RSSI) coupled to the switch, the RSSI and switch configured to implement polarization diversity between the three mutually orthogonal λ/4 monopole antenna.

4. The system of claim 1, further comprising a radio frequency (RF) coaxial connector coupled to the microstrip line.

5. The system of claim 1, wherein each of the sloped dielectric substrate walls forms a 45° angle with the substantially flat bottom dielectric substrate.

6. The system of claim 1, wherein the substantially flat bottom dielectric substrate is selected from a rectangular shape and a circular shape.

7. A 3D tripolar antenna system, comprising:

four sloped dielectric substrate walls extending from the flat bottom dielectric substrate; and three pairs of mutually orthogonal λ/4 monopole antenna, wherein each first one of a pair of mutually orthogonal λ/4 monopole antenna is printed on a first substrate wall that is opposite to a second substrate wall on which the second one of the pair of mutually orthogonal λ/4 monopole antenna is printed.

8. The system of claim 7, further comprising a microstrip line printed on the substantially flat bottom dielectric substrate and connected to each of the three pairs of mutually orthogonal λ4 monopole antenna.

9. The system of claim 8, further comprising a switch coupled to the microstrip line, the switch for selecting one of the three pairs of mutually orthogonal λ/4 monopole antenna.

10. The system of claim 9, wherein the system further comprises a radio signal strength indicator (RSSI) coupled to the switch, the RSSI and switch configured to implement polarization diversity between the three mutually orthogonal λ4 monopole antenna.

11. The system of claim 8, further comprising a radio frequency (RF) coaxial connector coupled to the microstrip line.

12. An additive manufacturing method for a 3D tripolar antenna system, the method comprising:

forming a 3D dielectric substrate using fused deposition modeling (FDM), wherein the 3D dielectric substrate comprises a substantially flat bottom dielectric substrate and at least three dielectric substrate walls extending from the flat bottom dielectric substrate;

forming three mutually orthogonal λ/4 monopole antenna on the 3D dielectric substrate using micro-dispensing of a conductive material, wherein each one of the three mutually orthogonal λ/4 monopole antenna is printed on a different one of the dielectric substrate walls; and forming a microstrip line using micro-dispensing of the conductive material on the substantially flat bottom dielectric substrate, wherein the microstrip line is connected to each of the three mutually orthogonal λ/4 monopole antenna.

13. The method of claim 12, wherein the 3D dielectric substrate is formed of acrylonitrile butadiene styrene (ABS) and the conductive material is a silver paste.

14. The method of claim 12, further comprising laser-scanning the 3D dielectric substrate to create a topography mesh to guide a micro-dispensing head to conform to a surface of the 3D dielectric substrate while depositing the conductive material to form the three mutually orthogonal λ/4 monopole antenna.

15. The method of claim 12, further comprising coupling a coaxial RF connector and a 3-way switch to the microstrip line.

16. The method of claim 12, wherein each of the dielectric substrate walls are sloped to form a 45° angle with the substantially flat bottom dielectric substrate.

17. The method of claim 12, wherein each of the dielectric substrate walls form about a 90° angle with the substantially flat bottom dielectric substrate.

18. The method of claim 12, wherein each of the three mutually orthogonal λ/4 monopole antenna further comprises a pair of antenna and wherein forming the three mutually orthogonal λ/4 monopole antenna using micro-dispensing further comprises, forming each first one of the pair of mutually orthogonal λ/4 monopole antenna on a first substrate wall that is opposite to a second substrate wall on which the second one of the pair of mutually orthogonal λ/4 monopole antenna is formed.

* * * * *